US008360843B2

(12) United States Patent
Barclay et al.

(10) Patent No.: US 8,360,843 B2
(45) Date of Patent: Jan. 29, 2013

(54) PRESENTING NETWORK-WIDE EVENTS IN NETWORK WAGERING VENUE

(75) Inventors: Brian J. Barclay, Atlanta, GA (US); Allon G. Englman, Chicago, IL (US); Andrew C. Guinn, Chicago, IL (US); Daniel P. Louie, Chicago, IL (US)

(73) Assignee: WMS Gaming, Inc., Waukegan, IL (US)

( * ) Notice: Subject to any disclaimer, the term of this patent is extended or adjusted under 35 U.S.C. 154(b) by 0 days.

(21) Appl. No.: 13/143,798

(22) PCT Filed: Jan. 14, 2010

(86) PCT No.: PCT/US2010/021089

§ 371 (c)(1),
(2), (4) Date: Jul. 8, 2011

(87) PCT Pub. No.: WO2010/083346

PCT Pub. Date: Jul. 22, 2010

(65) Prior Publication Data

US 2011/0269548 A1 Nov. 3, 2011

Related U.S. Application Data

(60) Provisional application No. 61/144,907, filed on Jan. 15, 2009.

(51) Int. Cl.
*A63F 9/24* (2006.01)

(52) U.S. Cl. ..... 463/16

(58) Field of Classification Search ..... 463/16
See application file for complete search history.

(56) References Cited

U.S. PATENT DOCUMENTS

| | | | | |
|---|---|---|---|---|
| 4,856,787 | A * | 8/1989 | Itkis | 273/237 |
| 2003/0003990 | A1 | 1/2003 | Von Kohorn | |
| 2005/0003880 | A1 | 1/2005 | Englman et al. | |
| 2006/0121971 | A1 | 6/2006 | Slomiany et al. | |
| 2006/0135243 | A1 | 6/2006 | Englman et al. | |
| 2006/0247041 | A1 | 11/2006 | Walker et al. | |
| 2008/0039196 | A1 | 2/2008 | Walther et al. | |
| 2008/0161101 | A1 | 7/2008 | Lutnick et al. | |
| 2008/0254893 | A1 | 10/2008 | Patel et al. | |
| 2008/0282286 | A1 | 11/2008 | Or | |
| 2008/0311996 | A1 * | 12/2008 | Belton et al. | 463/42 |

FOREIGN PATENT DOCUMENTS

| | | |
|---|---|---|
| WO | WO2008049871 | 5/2008 |
| WO | WO2010083346 | 7/2010 |

OTHER PUBLICATIONS

"PCT Application No. PCT/US10/21089 International Preliminary Report on Patentability", Mar. 28, 2011 , 12 pages.
"PCT Application No. PCT/US10/21089 International Search Report", Apr. 5, 2010 , 12 pages.

* cited by examiner

*Primary Examiner* — Omkar Deodhar
(74) *Attorney, Agent, or Firm* — DeLizio Gilliam, PLLC

(57) ABSTRACT

A wagering game system its operations are described herein. In embodiments, the operations can include determining a player account, from a network wagering venue, that is eligible to participate in a network-wide wagering game event, and selecting the player account to be a player that performs for an audience of other users. The player can win at least some portion of awards by playing a wagering game during the network-wide wagering game event. Audience member users can participate in the event using interactive features (e.g., betting features, chat features, etc.) presented in a presentation, or view, of the network-wide wagering game event. The operations can also include involving, or incorporating, the audience members, into the network-wide wagering game event in a variety of ways, such as assisting the player participant to perform better at the wagering game, engaging in side-bets, receiving awards, etc.

14 Claims, 11 Drawing Sheets

PRESENTING NETWORK-WIDE EVENTS IN NETWORK WAGERING VENUE

RELATED APPLICATIONS

This application claims the priority benefit of U.S. Provisional Application Ser. No. 61/144,907 filed Jan. 15, 2009.

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2010, WMS Gaming, Inc.

TECHNICAL FIELD

Embodiments of the inventive subject matter relate generally to wagering game systems and networks that, more particularly, presenting network-wide events in a network wagering venue.

BACKGROUND

Wagering game machines, such as slot machines, video poker machines and the like, have been a cornerstone of the gaming industry for several years. Traditionally, wagering game machines have been confined to physical buildings, like casinos (e.g., resort casinos, roadside casinos, etc.). The casinos are located in specific geographic locations that are authorized to present wagering games to casino patrons. However, with the proliferation of interest and use of the Internet, shrewd wagering game manufacturers have recognized that a global public network, such as the Internet, can reach to various locations of the world that have been authorized to present wagering games. Any individual with a personal computing device (e.g., a personal computer, a laptop, a personal digital assistant, a cell phone, etc.) can connect to the Internet and process wagering games. Consequently, some wagering game manufacturers have created wagering games that can be processed by personal computing devices and offered via online casino websites ("online casinos"). However, online casinos face challenges and struggles. For instance, online casinos have struggled to provide the excitement and entertainment that a real-world casino environment provides. Some online casinos have struggled enforcing jurisdictional restrictions and requirements. Further, some online casinos have struggled adapting the online gaming industry to a traditionally non-wagering game business environment. As a result, wagering game manufacturers, casino operators, and online game providers face growing pains and challenges in making the online gaming industry appealing and profitable.

SUMMARY

In some embodiments, a method comprises determining one or more player accounts that are eligible to participate in a network-wide wagering game event to win at least some portion of awards available for the network-wide wagering game event on a network wagering venue; selecting at least one of the one or more player accounts to be a player that plays in the network-wide wagering game event; presenting a notification to users of the network wagering venue that the player will play the network-wide wagering game event; determining that at least some of the users desire to participate in the network-wide wagering game event as audience member users; presenting a view of the network-wide wagering game event to the player and the audience member users, wherein the player can play the network-wide wagering game event and the audience member users can watch and participate as audience members; and presenting one or more interactive user features to the audience member users that the audience member users can use to participate as audience members of the network-wide wagering game event.

In some embodiments, determining the one or more player accounts are eligible to participate in the network-wide wagering game event comprises determining that the one or more player accounts have made a wager on any game within the network wagering venue within a given time period.

In some embodiments, selecting the at least one of the one or more player accounts to be the player comprises selecting multiple players to play multiple, independent instances of the network-wide wagering game event.

In some embodiments, selecting the at least one of the one or more player accounts to be the player comprises selecting the at least one of the one or more player accounts based on one or more of a number of social contacts associated with the player, activity of friends associated with the player, an auction held to be a selected player, and performance in a group competition.

In some embodiments, presenting the notification to users of the network wagering venue comprises one or more of presenting the notification on a network-wide news feed for the network wagering venue, broadcasting the notification via an instant messaging network, and presenting a counter that indicates a short time period before the network-wide wagering game event will occur.

In some embodiments, presenting the notification to the users of the network wagering venue comprises presenting the notification to one or more social contacts associated with the player, wherein the social contacts have indicated that they want to be notified via a user account preference.

In some embodiments, presenting the one or more interactive user features to the audience member users comprises presenting one or more of shadow betting features, side betting features, chat features, and game assistance features that an audience member can use to assist the player in the network-wide wagering game event.

Some embodiments include one or more machine-readable media having instructions stored thereon, which when executed by a set of one or more processors causes the set of one or more processors to perform operations comprising receiving one or more contribution amounts to a site-wide progressive bonus game from all available wagering games played on an online wagering venue; determining that an online wagering account user is eligible to participate in the site-wide progressive bonus game; selecting the online wagering account user to be a player participant of the site-wide progressive bonus game; storing a state of a wagering base game that the player participant is currently playing; presenting a site-wide presentation of the site-wide progressive bonus game to the player participant and to one or more viewing participants from the online wagering venue; determining a completion of the site-wide progressive bonus game; and restoring the wagering base game to the state that was stored.

In some embodiments, the operations further comprise configuring all wagering games available on the online wagering venue to provide the one or more contribution amounts.

In some embodiments, the operation of determining that the online wagering account user is eligible to participate in the site-wide progressive bonus game includes operations further comprises determining eligibility for participation based on one or more of a hold percentage and a bet amount for a wagering game that the online wagering account user is playing on the online wagering venue.

In some embodiments, the operation of presenting the site-wide presentation of the site-wide progressive bonus game to the player participant includes operations further comprises presenting a picker grid of selectable game play elements; associating each of the selectable game play elements with a game result element, wherein the game result element is revealed when the player participant selects an associated selectable game play element; determining a selected game play element; revealing an associated game result element with the selected game play element in the site-wide presentation to the player participant and to the one or more viewing participants; and incorporating audience participation, from the one or more viewing participants, into the site-wide presentation.

In some embodiments, the game result element comprises one or more of a win result element, a progression result element, a loss result element, and a game goal result element that terminates the site-wide progressive bonus game with a game completion award, and said operations further comprises if the associated game result element is the progression result element progressing the site-wide progressive bonus game to one or more successive additional game rounds; if the associated game result element is a win result element providing an award to one or more of the player participant and one or more of the viewing participants; if the associated game result element is a loss result element terminating the site-wide progressive bonus game with a loss result; and if the associated game result element is a loss result element terminating the site-wide progressive bonus game with the game completion award.

In some embodiments, if the associated game result element is the progression result element, for each of the one or more successive additional game rounds, the operations further comprise: increasing the chances of revealing a loss result element; and increasing a monetary value of the awards available for revealing a win result element.

In some embodiments, the operations further comprise presenting options for a user to replay the site-wide presentation.

In some embodiments, the operations further comprise incorporating third-party merchandise as awards for one or more of the player participant and the one or more viewing participants.

In some embodiments, a system comprises a server that includes a content controller configured to control content for a presentation of a network-wide wagering game event in a network wagering venue. The server can also comprise a network event controller configured to determine a performing participant for the network-wide wagering game event, invite one or more observer participants to view and participate in the presentation of the network-wide wagering game event, control interactivity between one or more of the performing participant and the one or more observer participants within the presentation of the network-wide wagering game event, and incentivize the one or more observer participants to participate as audience members during the network-wide wagering game event. The server can also include a network event social feature controller configured to present controls that the one or more observer participants use to interact within the presentation of the network-wide wagering game event, and a social network award controller configured to provide awards to the one or more observer participants that participate socially via the presentation of the network-wide wagering game event. The system can also include a client device comprising a content controller configured to present the presentation of the network-wide wagering game event.

In some embodiments, the server further comprises an agency controller configured to determine that the performing participant is not logged on to a user network associated with the network wagering venue, and perform one or more of: selecting an assigned agent to participate in the network-wide wagering game event in place of the performing participant, holding the network-wide wagering game event until the performing participant is available, and connecting the performing participant to the network wagering venue via a mobile device to participate in the network-wide wagering event remotely.

In some embodiments, the social network award controller is further configured to provide as awards one or more of a special game for the one or more observer participants to play while watching the network-wide wagering game event, prizes for watching the network-wide wagering game event, third-party merchandise awards, advertising offers, and awards for being recognized during the network-wide wagering game event.

In some embodiments, an apparatus comprises a wagering game module configured to present a site-wide presentation of the site-wide progressive bonus game to a player participant and to one or more viewing participants from an online wagering venue, and to present, in the site-wide presentation, a picker grid of selectable game play elements, associate each of the selectable game play elements with a game result element, wherein the game result element is revealed when the player participant selects an associated selectable game play element, and wherein the game result element is at least one of one or more of a win result element that provides an award. The apparatus can also include a progression result element that advances game play to a successive round of the site-wide progressive bonus game, and a loss result element that terminates the site-wide progressive bonus game with a loss result, determines a selected game play element, reveals the associated game result element with the selected game play element in the site-wide presentation to the player participant and to the one or more viewing participants, and incorporates audience participation, from the one or more viewing participants, into the site-wide presentation.

In some embodiments, the wagering game module is further configured to determine one or more activities performed by one or more of the viewing participants, and adjust game play for the site-wide progressive bonus game based on the activities.

In some embodiments, the wagering game module is configured to adjust the game play for the site-wide progressive bonus game by being further configured to perform, based on successive completion of the activities, one or more of decreasing chances of revealing a loss result element and increasing chances of revealing a win result element.

In some embodiments, an apparatus comprises means for determining one or more player accounts that are eligible to participate in a network-wide wagering game event to win at least some portion of awards available for the network-wide wagering game event on a network wagering venue; means for selecting at least one of the one or more player accounts to be a player that plays in the network-wide wagering game event; means for presenting a notification to users of the network wagering venue that the player will play the network-wide wagering game event; means for determining that at least some of the users desire to participate in the network-wide wagering game event as audience member users; means for presenting a view of the network-wide wagering game event to the player and the audience member users, wherein the player can play the network-wide wagering game event and the audience member users can watch and participate as audience members; and means for presenting one or more interactive user features to the audience member users that the audience member users can use to participate as audience members of the network-wide wagering game event.

In some embodiments, the apparatus further comprises means for presenting one or more options for the player to select one or more audience members to assist the player in the network-wide wagering game event.

In some embodiments, the apparatus further comprises means for determining one or more activities performed by one or more of the audience members; and means for increasing the player's chances of obtaining a desired goal in the network-wide wagering game event based on the one or more activities.

In some embodiments, the means for selecting the at least one of the one or more player accounts to be the player that plays in the network-wide wagering game event further comprises, means for associating as selection factors one or more of activity performed by the one or more player accounts previous to selecting the at least one or more of the one or more player accounts and an external event that occurs outside of the network wagering venue that has a predictable occurrence with a random value.

BRIEF DESCRIPTION OF THE DRAWING(S)

Embodiments are illustrated in the Figures of the accompanying drawings in which.

DESCRIPTION OF ILLUSTRATIVE EMBODIMENTS

Figure 1:
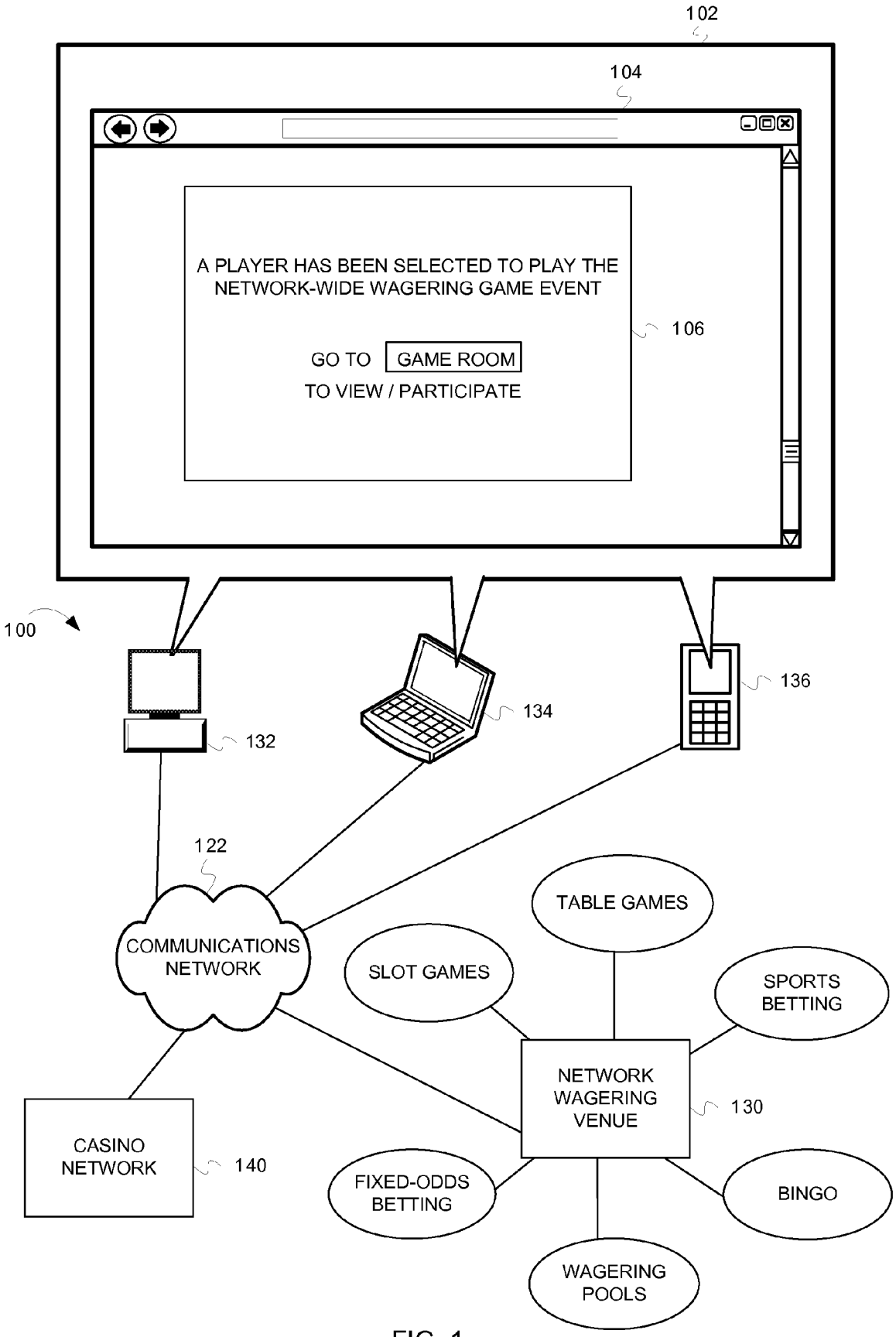
FIG. 1 is an illustration of notifying network users that a network-wide wagering game event is commencing, according to some embodiments.

This description of the embodiments is divided into six sections. The first section provides an introduction to embodiments. The second section describes example operating environments while the third section describes example operations performed by some embodiments. The fourth section describes additional example embodiments while the fifth section describes additional example operating environments. The sixth section presents some general comments.

Introduction

This section provides an introduction to some embodiments.

Wagering games are expanding in popularity. Many wagering game enthusiasts are demanding greater access to wagering games and content related to wagering games. As stated previously, some wagering game companies have created online wagering game websites that provide a way for wagering game enthusiasts to play wagering games while connected to the Internet (e.g., via a web-browser). Some online wagering game websites provide various features, such as social network functionality. Social networks allow wagering game players ("players") to create user accounts with one or more unique identifiers that represent an online persona. One example of a unique identifier is a profile that describes personal information about the user. Another example of a unique identifier is an "avatar". Avatars are graphical, "cartoon-like" depictions of a social network persona. These online personas, unique identifiers, profiles, associated avatars, etc., add to the fun of belonging to a social network. Many online casinos, however, present an unsatisfactory wagering game experience to players who enjoy a more true-to-life gaming experience. Some players avoid the artificial feel of online casinos and gaming websites, even online casinos with some social network features, in favor of the feel and atmosphere provided by a physical, or "brick-and-mortar", casino. Embodiments of the inventive subject matter, however, present solutions to many of those challenges. For example, embodiments describe examples of presenting a network-wide wagering game event in a network wagering venue (e.g., an online casino, a wagering game website, a wagering network, etc.). The network-wide wagering game event may also be referred to herein as a network-wide event, or site-wide event (for wagering events presented on a website). The network-wide wagering game event can be presented over any type of communications network (e.g., public or private) that provides access to wagering games, such as a website (e.g., via wide-area-networks, or WANs), a private gaming network (e.g., via large-area-networks, or LANs), a file sharing network, a social network, etc., or any combination of networks. Multiple users can be connected to the networks via computing devices. In embodiments, the multiple users can have access and/or participate, in a network-wide event, whether as a wagering game player ("player"), an observer, or some other type of participant. The multiple users can have accounts that subscribe to specific services, such as account-based wagering systems (e.g., account-based wagering game websites, account-based casino networks, etc.). In some embodiments herein a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing in a network-wide event. Although a player, or person, may be activating a control to perform the activity, the player account, at the computer level, is associated with the player, and any associated devices that communicate the control activation to a processor, a server, or other device and/or initiates computerized instructions to perform the activation. Therefore, for brevity, to avoid having to describe the interconnection between player and player account in every instance, a "player account" may be referred to herein in either context. Further, in some embodiments herein, the word "gaming" is used interchangeably with "gambling".

FIG. 1 is a conceptual diagram that illustrates an example of notifying network users that a network-wide wagering game event is commencing, according to some embodiments. In FIG. 1, a wagering game system ("system") 100 can include multiple network-enabled clients ("clients") 132, 134, 136 (e.g., computer systems, laptops, cell phones, personal digital assistants, applications, etc.) that can connect to and communicate data via a communications network 122. Also connected to the communications network 122 is a network wagering venue 130. The network wagering venue 130 may also be referred to in some embodiments as a network wagering game venue, an online wagering venue, an online wagering website, a wagering network, or some other description that describes a location, or venue, where users can perform many types of wagering activity. The network wagering venue 130 can provide various types of wagering-related content, such as wagering games for users to gamble with, or other computerized or electronic-enabled gambling activity. The network wagering venue 130 can provide access to all types of activity that involves some degree of chance and gambling, or betting, based on the chance. Gambling games and activities offered on the network wagering venue 130 can include, but not necessarily be limited to, casino games, slot games, table games, sports betting, bingo, wagering pools, fixed-odds betting, and so forth. The network wagering venue 130 can include account servers (e.g., wagering account servers, social network account servers, etc.), that users can subscribe to, and on which the users can store personal, accounting, and other information. The network wagering venue 130 can also include one or more servers that provide wagering-related content to the clients 132, 134, 136. Clients 132, 134, 136 can present, respectively, a display 102 that presents an application capable of presenting network content, such as a web browser 104. Some client devices (e.g., the "cell phone" client 136) may present more compact displays of content because of limited screen space. The web browser 104 can present different wagering related content at different times to different users that utilize the clients 132, 134, 136 to access the network wagering venue 130. Sometimes, however, the system 100 can present a network-wide (e.g., site-wide) event in which all users can access and/or participate in, either as a wagering game participant (e.g., a player) or as an observer (e.g., an audience member). The system 100 can notify all users of the network wagering venue 130 (e.g., via a notification panel 106) that the event has commenced and provide participation options, settings and/or controls that a user can use to participate in the event. A casino network 140 can also be connected to the communications network 122. The casino network 140 can present wagering games on wagering game machines (e.g., FIGS. 10 and 11), and other client type devices, within the casino network 140. The wagering game machines, and other client type devices, can also access the network-wide event. In some embodiments, the network-wide event can select any user of the network wagering venue 130 to perform an activity that other users may find entertaining. For example, the network-wide event can present a user's activity when playing a specific game that at which the user is having an amazing run of luck or that is especially important. In other examples, the system 100 can select a user, or users, to perform a special wagering game, as a bonus game. In both these examples, and in other examples, a user's wagering activity can provide a form of entertainment that other users may find interesting, and which other users may want to participate in as observers, betters, etc. In some embodiments, the system 100 can hold contribution amounts from all bets for any wagering activity performed within the network wagering venue 130, whether on traditional casino games or other gambling activity. All users, therefore, of any gambling activity can be eligible to be selected by the system 100 as a host, player, or other performing participant of the network-wide event.

Although FIG. 1 describes some embodiments, the following sections describe many other features and embodiments.

Example Operating Environments

This section describes example operating environments and networks and presents structural aspects of some embodiments. More specifically, this section includes discussion about wagering game system architectures.

Wagering Game System Architecture

Figure 2:
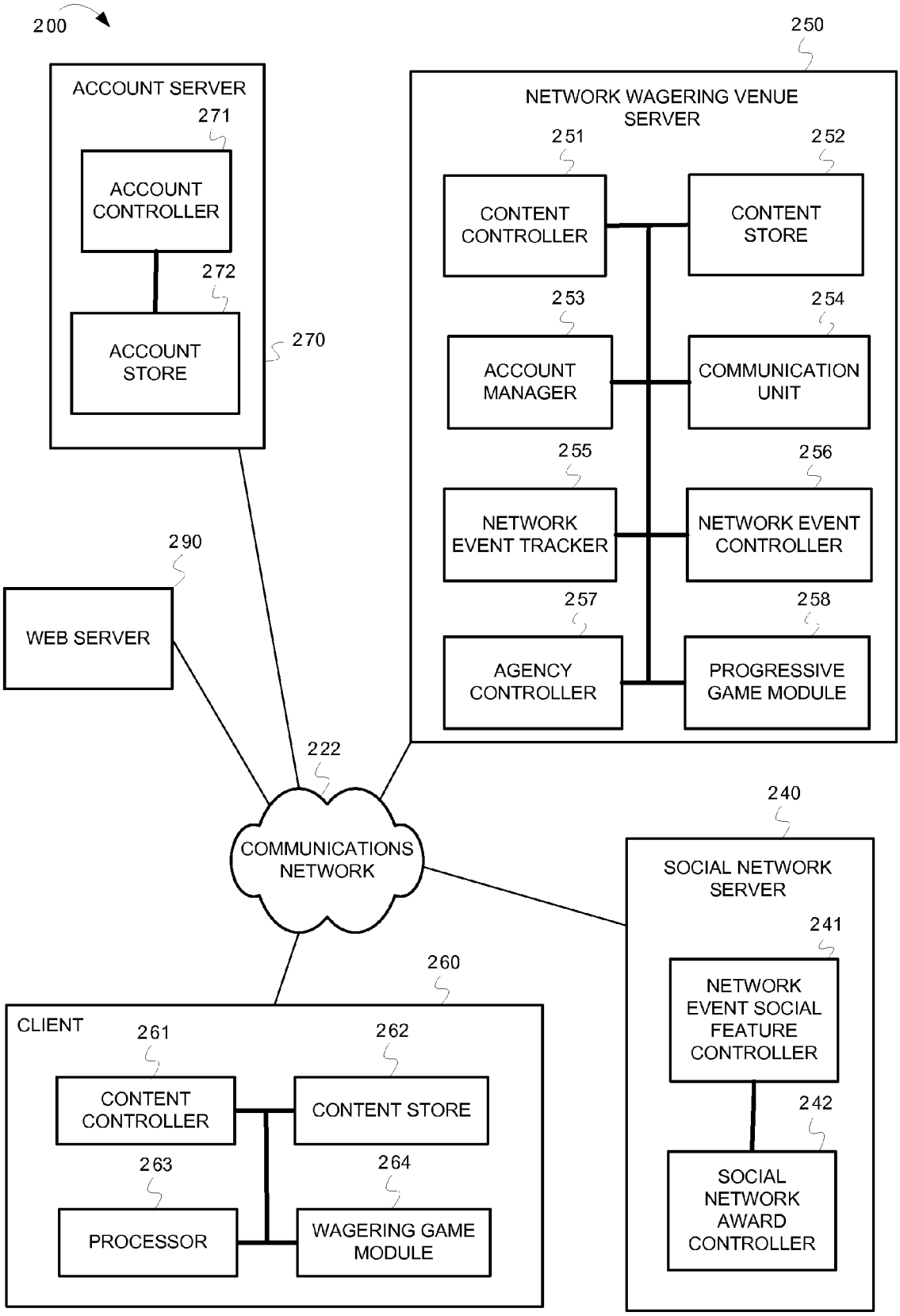
FIG. 2 is an illustration of a wagering game system architecture 200, according to some embodiments.

FIG. 2 is a conceptual diagram that illustrates an example of a wagering game system architecture 200, according to some embodiments. The wagering game system architecture 200 can include an account server 270 configured to control user related accounts accessible via a network wagering venue, a wagering game network, a social network, etc. The account server 270 can store and track player information, such as identifying information (e.g., avatars, screen name, account identification numbers, etc.) or other information like financial account information, social contact information, etc. The account server 270 can contain accounts for social contacts referenced by the player account. The account server 270 can also provide auditing capabilities, according to regulatory rules, and track the performance of players, machines, and servers. The account server 270 can include an account controller 271 configured to control information for a player's account. The account server 270 can also include an account store 272 configured to store information for a player's account.

The wagering game system architecture 200 can also include a network wagering venue server 250 configured to control wagering game content, provide random numbers, and communicate wagering game information, account information, and other information, to and from a client 260. The network wagering venue server 250 can include a content controller 251 configured to manage and control content for the presentation of content on the client 260. For example, the content controller 251 can generate game results (e.g., win/loss values), including win amounts, for games played on the client 260. The content controller 251 can communicate the game results to the client 260. The content controller 251 can also generate random numbers and provide them to the client 260 so that the client 260 can generate game results. The network wagering venue server 250 can also include a content store 252 configured to contain content to present on the client 260. The network wagering venue server 250 can also include an account manager 253 configured to control information related to player accounts. For example, the account manager 253 can communicate wager amounts, game results amounts (e.g., win amounts), bonus game amounts, etc., to the account server 270. The network wagering venue server 250 can also include a communication unit 254 configured to communicate information to the client 260 and to communicate with other systems, devices and networks. For example, the communication unit 254 can track and communicate with community wagering game servers, account servers, community servers, social networking servers, file sharing servers, etc. The network wagering venue server 250 can also include a network event tracker 255 configured to track data related to network-wide wagering game events, including data related to game results, awards, social contacts, player accounts, etc. The network wagering venue server 250 can also include a network event controller 256 configured to control presentation of network-wide wagering game events including controlling views of network-wide games, selecting players to play the network-wide games, inviting network users to view and participate in the network-wide games, controlling interactivity and communication between players and other network users, etc. The network wagering venue server 250 can also include an agency controller 257 configured to determine data related to long-term, network-wide games, determine that a selected player is off-line, and generate options for wagering agents to perform a network-wide game as an agent of the selected user account. The network wagering venue server 250 can also include a progressive game module 258 configured to determine contribution holds from wagering game bets from all wagering games available on a network wagering venue, and associate the holds with a progressive jackpot.

The wagering game system architecture 200 can also include at least one client 260 configured to present wagering games and receive and transmit information to control and present online wagering games. The client 260 can include a content controller 261 configured to manage and control content and presentation of network wagering venue content on the client 260. The client 260 can also include a content store 262 configured to contain content to present on the client 260. The client 260 can also include a processor 263 configured to process wagering game content, present online wagering game objects, control gaming devices, etc. The client 260 can also include a wagering game module 264 configured to control presentation of network-wide wagering game events for a network wagering venue.

The wagering game system architecture 200 can also include a web server 290 configured to control and present an online website that hosts wagering games and other wagering activity.

The wagering game system architecture 200 can also include a social network server 240 configured to control social network interactivity, features, and functionality for a wagering game social network, or other social networks, integrated with a network wagering venue. The social network server 240 can include a network event social feature controller 241 configured to present features that users of a social network can utilize in conjunction with a wagering game network, a wagering game website, an online casino, or other network gaming venue. For example, audience members that are social contacts with a player can interact with each other, and with the player, during a network-wide gaming event. In some embodiments, the network event social feature controller 241 can also be a part of the network wagering venue server 250. The network event social feature controller 241 can provide chat features, betting features, award features, award redemption features, etc. The social network server 240 can also include a social network award controller 242 configured to provide awards to user accounts that participate socially (e.g., as audience members) of a network-wide wagering game event. The social network award controller 242 can offer incentives and awards for participating as observers and interactive participants of the network-wide wagering game event. The social network award controller 242 can also redeem awards, Each component shown in the wagering game system architecture 200 is shown as a separate and distinct element connected via a communications network 222. However, some functions performed by one component could be performed by other components. For example, the network wagering venue server 250 can also be configured to perform functions of the content controller 261, the content store 262, the wagering game module 264, the network event social feature controller 241, the social network award controller 242, and other network elements and/or system devices. Furthermore, the components shown may all be contained in one device, but some, or all, may be included in, or performed by multiple devices, as in the configurations shown in FIG. 2 or other configurations not shown. For example, the progressive game module 258 may itself be a separate server, or associated with other servers (e.g., a progressive game server). In another example, the account manager 253 and the communication unit 254 can be included in the client 260 instead of, or in addition to, being a part of the network wagering venue server 250. Further, in some embodiments, the client 260 can determine wagering game outcomes, generate random numbers, etc. instead of, or in addition to, the network wagering venue server 250. In some embodiments, the client 260 can be a wagering game machine. A wagering game machine can take any suitable form, such as floor standing models, handheld mobile units, bar-top models, workstation-type console models, surface computing machines, etc. Further, a wagering game machine can be primarily dedicated for use in conducting wagering games, or can include non-dedicated devices, such as mobile phones, personal digital assistants, personal computers, etc.

In some embodiments, clients (e.g., computer systems, wagering game machines, etc.) and servers (e.g., network wagering venue server 250, wagering game servers, etc.) work together such that the clients can be operated as thin, thick, or intermediate clients. For example, one or more elements of game play may be controlled by a client or a server. Game play elements can include executable game code, lookup tables, configuration files, game outcome, audio or visual representations of the game, game assets or the like. In a thin-client example, the server can perform functions such as determining game outcome or managing assets, while the client can present a graphical representation of such outcome or asset modification to the user (e.g., player). In a thick-client example, the client can determine game outcomes and communicate the outcomes to the server for recording or managing a player's account.

In some embodiments, either the client or the server can provide functionality that is not directly related to game play. For example, account transactions and account rules may be managed centrally (e.g., by the network wagering venue server 250, or other wagering game server(s)) or locally (e.g., by the client 260). Other functionality not directly related to game play may include power management, presentation of advertising, software or firmware updates, system quality or security checks, etc.

Furthermore, the wagering game system architecture 200 can be implemented as software, hardware, any combination thereof, or other forms of embodiments not listed. For example, any of the network components (e.g., the wagering game machines, servers, etc.) can include hardware and machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
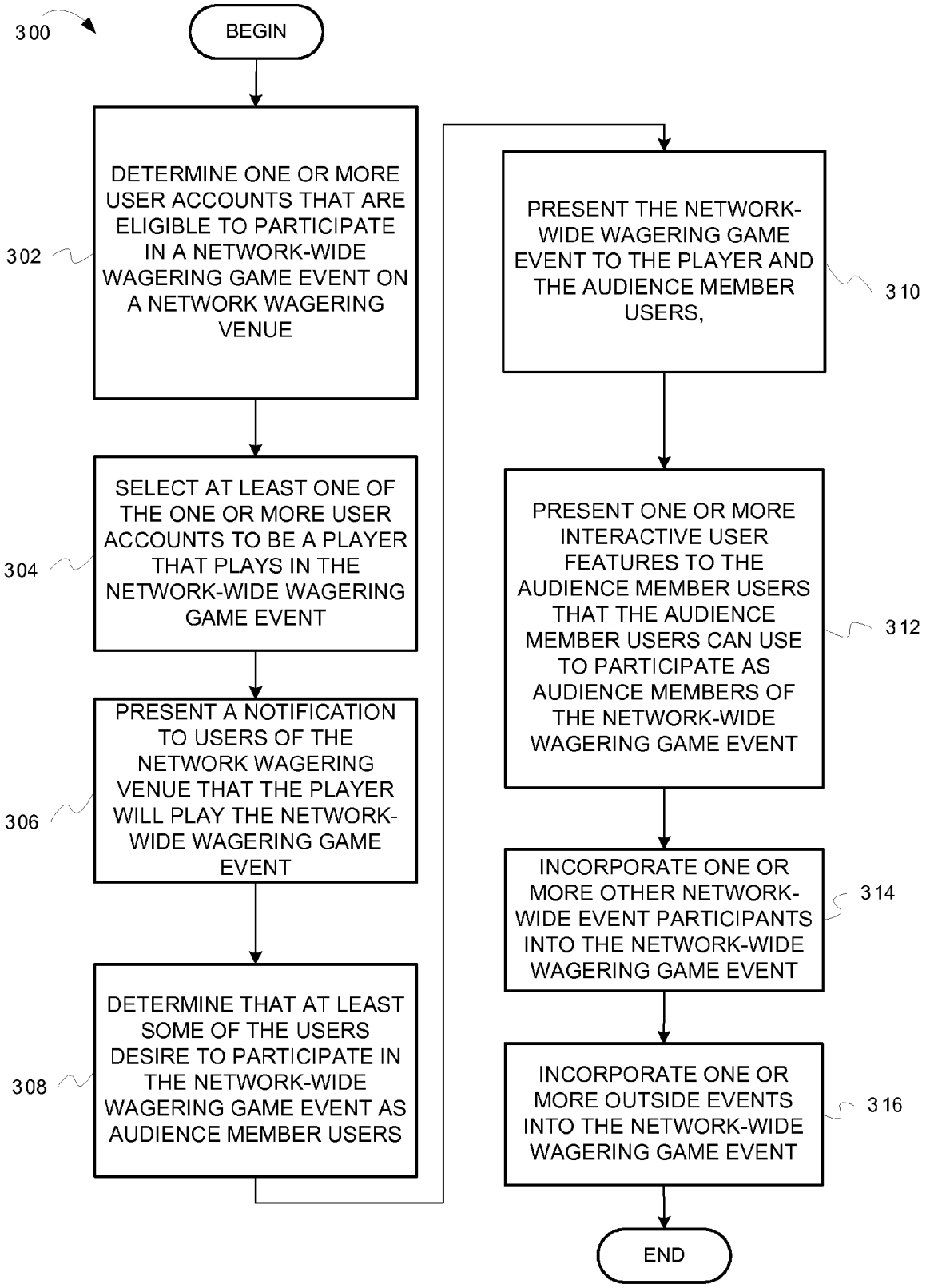
FIG. 3 is a flow diagram 300 illustrating presenting network-wide wagering game events in a network wagering venue, according to some embodiments.
Figure 6:
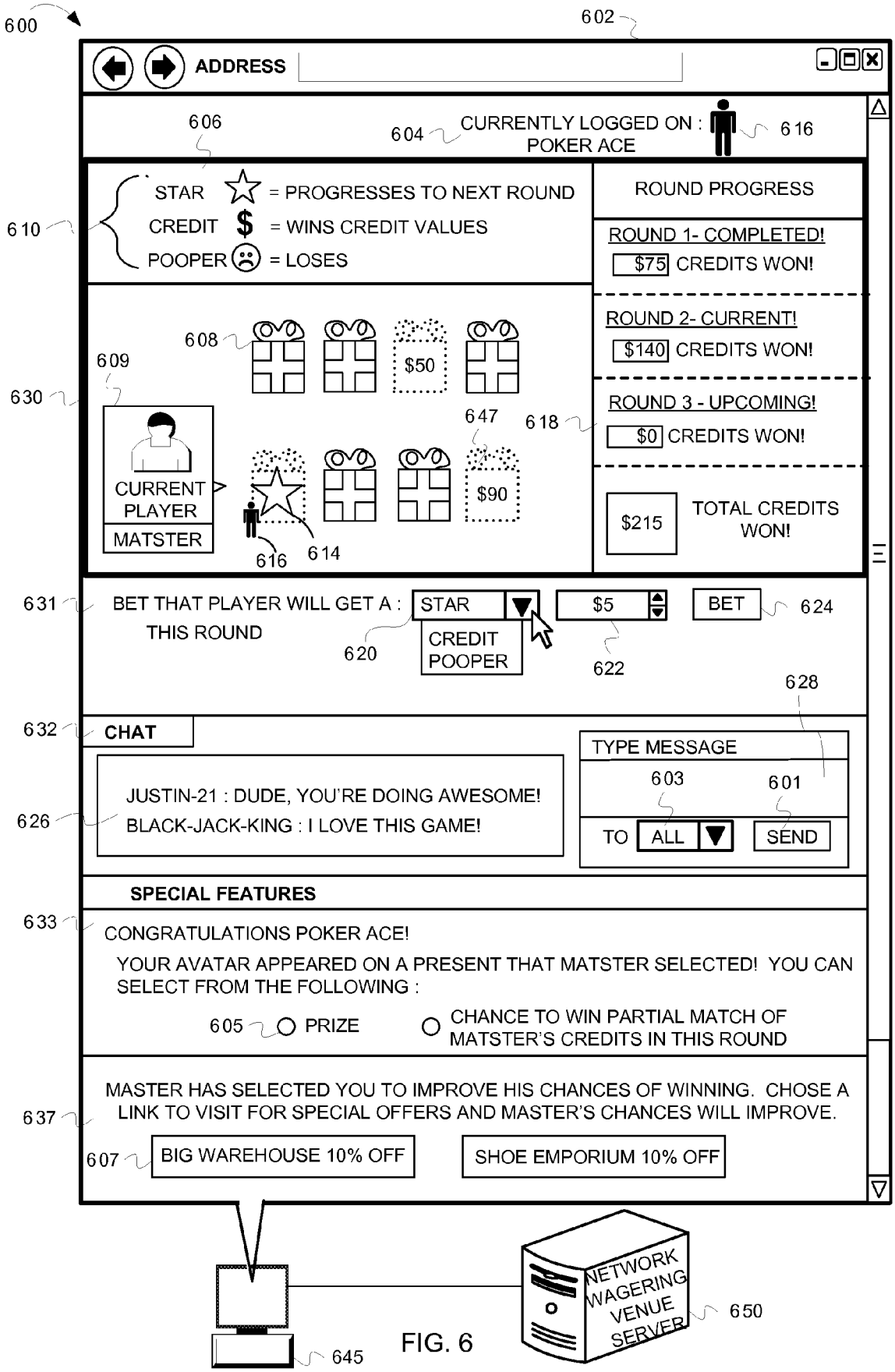
FIG. 6 is an illustration of presenting a site-wide, progressive bonus game, according to some embodiments.

FIG. 3 is a flow diagram ("flow") 300 illustrating presenting network-wide wagering game events in a network wagering venue, according to some embodiments. FIGS. 1 and 6 are conceptual diagrams that help illustrate the flow of FIG. 3, according to some embodiments. This description will present FIG. 3 in concert with FIGS. 1 and 6. In FIG. 3, the flow 300 begins at processing block 302, where a wagering game system ("system") determines one or more user accounts that are eligible to participate in a network-wide wagering game event. The network-wide wagering game event can occur on a network wagering venue, such as a website. The system can determine that the one or more user accounts are eligible to win at least some portion of awards available for the network-wide wagering game event. For instance, the system can determine that the players have met or performed one or more qualifying operations, activities, tasks, or conditions. For example, the system can determine that a player has collected multiple items on a website, from various wagering games. In another example, the system can determine that a player has made a wager on any wagering game within the network wagering venue within a given time period. The system can require that the player perform financial requirements, such as wagering, or betting, certain limits of money (e.g., $10 denomination bets qualify for some types of network-wide events, whereas $1 denomination bets qualify for other types of network-wide events). The network-wide event can allow all users of the network wagering venue to be eligible for some events as some form of participant (e.g., the system can review everyone's account for the last 30 seconds or minute before triggering the network-wide event, and determine that players that have bet within that time period are eligible to play the network-wide wagering game event). For instance, a player may be eligible to be selected as a host, or performing participant, based on certain qualifications made by that player, while all other users of the network wagering venue can also participate, but as lesser participants (e.g., audience members). The system can provide different awards to different types of participants. For example, the system can provide monetary awards, credits, cash, etc. to performing participants for performing during the event. The system can provide lesser awards, in some cases, to audience member participants, for performing as audience members during the event. In some embodiments, the network-wide event is a surprise, or mystery, event, that the system presents at random times. In other embodiments, however, the system can pre-plan the network-wide events and send out invitations far in advance. The system can notify players of qualifying activities that the players must perform to be eligible to participate as players, or playing performers, for the event (e.g., play five different wagering games within a week's period). In some embodiments, the eligibility could be based on group play or a competition environment (e.g., the system indicates that at the end of the week it will hold a network-wide wagering game event, but to be eligible to perform, a user will have to complete or perform a certain number of group activities to be eligible).

The flow 300 continues at processing block 304, where the system selects at least one of the one or more user accounts to be a player that plays in the network-wide wagering game event. In some embodiments, the system can allow a single player into the network-wide wagering game event as a player participant and can show only the first player in the event (i.e., lock out views of other people). In other embodiments, however, the system can present multiple independent instances of the network-wide wagering game event. For example, multiple players can trigger multiple different, independent, instances of the network-wide wagering game event at, or around, the same time. When multiple players are in the network-wide wagering game event, then the system can present multiple views (e.g., split screens of the event) or give options for users to select which event they would like to attend at the time. Thus, users can have the option to select which event in which they want to participate. In some embodiments, the system can provide features so that a user account can subscribe to see only friends' instances of network-wide wagering game events instead of others they do not know, if they occur at the same time. Some network-wide events can be so significant, however, that system may only present one instance of the network-wide wagering game event, although multiple players may be eligible to participate. In some embodiments, the system can randomly select one person to perform for the entire group of eligible participants. In other embodiments, however, the system can select multiple players to players to perform in turns in the event. Whoever is currently performing (whether one person at a time, or in turns) the system can determine an avatar for the player and put their avatar in a prominent place on the view of the network-wide wagering game event (e.g., in the center of a screen view) to indicate who is performing. The system can randomly select who is next. Some players who are in the event can opt out of performing. Some players can group together as groups to perform. The system can choose the performer based on a number of friends. The system can also choose performers based on recent activity performed by their friends on the network wagering venue. The system can also auction the opportunity to perform in the event. For instance, if multiple players are eligible, the system could hold an auction for the opportunity to be selected as the player participant. In some embodiments, when the award for the network-wide event is incremental, and progressive (e.g., when an award for participating in the network-wide event is a progressive jackpot), then the system can increase the auction increments as the progressive jackpot amount grows. The system could also have a "buy-it-now" option, to by-pass the auction process if the player provides a high enough bid. In some embodiments, the system can include unknown, or random, components, into the selection process to reduce the predictability of the selection process. In some embodiments, the system can select players that are not logged in to the network wagering venue, such as players who have characters running in long-term games on the system (e.g., fish-tank games that are running while the player is not logged on). In such cases, the system can present a remote notification (e.g., email, instant message, text message, phone call, etc.) to the player who is not logged and hold the network-wide wagering game event for the player until the player can log on again. The system can also can assign agency, or provide an option for the player to assign an agent (e.g., friend, bot, etc.) to play the game for them if the player's account is selected when the player is not logged on. The system can also present capabilities for a player to play remotely (e.g., via a cell phone).

The flow 300 continues at processing block 306, where the system presents a notification to users of the network wagering venue that the player will play the network-wide wagering game event. In some embodiments, the system can present a notification to all users that are logged on. In one example, the system can interact with a news feed, ticker, etc. on a website so that when a player enters the network-wide wagering game event, the news feed breaks out of its normal mode to notify all users on the site that someone has entered the network-wide wagering game event. The system can also publish the news feed on an instant messaging network, so that it sends messages to users that are logged in or logged off and to contacts of those users that may be outside of the network wagering venue network. In some embodiments, when a network-wide event has been triggered, or when a network-wide event will be initiated, the system can present a count-down meter (and accompanying visual and audio effects) that indicate an amount of time until a player will enter the network-wide wagering game event. The system can select a time period for the counter that serves a marketing purpose. For example, in some embodiments, the system can select a time period that is long enough to engage maximum interest in the event or to allow users enough time to complete qualifying activities that would make them eligible to potentially participate as player participants. In other embodiments, however, the system can first select a player and then present the count-down meter. The system can notify users that someone has already been selected so that users are not confused into thinking that they might be able to qualify for that particular event based on current activity. In some embodiments, the system can present a notification to all social contacts of the player, that may not be online, which have indicated a desire to be notified when the player is selected to play the network-wide wagering game event.

The flow 300 continues at processing block 308, where the system determines that at least some of the users desire to participate in the network-wide wagering game event as audience member users. In some embodiments, the system can present a control (e.g., a button), a link, a news feed, or other mechanism where a user can select an item presented on a web-browser, or other display, on a client. For example, in the case of a news feed, the user can click on the news feed that indicates the network-wide wagering game event to express a desire to view the event. FIG. 1 shows a notification panel 106 that pops up and presents a button for the user to view a game room, a chat room, or other such view, of the network-wide wagering game event. In some embodiments, the system can read from an account setting that indicates that the user would automatically want to participate when the player is selected.

The flow 300 continues at processing block 310, where the system presents a presentation of the network-wide wagering game event to the player and the audience member users. The presentation can include a web-page, a Flash-animation, toolbars, videos, image maps, graphics, chat screens, instant messaging controls, player settings, sounds, etc., or any combinations thereof. The presentation can present different controls and functionality to a participant of the event based on the participant's role in the event. For example, the system can present playing controls (e.g., spin buttons, selector buttons or functions, etc.) to a player participant, so that the player can activate, select, control, or otherwise manipulate playing elements of the network-wide wagering game event. On the other hand, if a user is an audience member participant, the system can present a view that shows a representation (e.g., an avatar) of the player participant as the player participant plays the event, but the system would not necessarily provide playing controls to the audience member participant. However, the system can provide user communication functionality so that the audience member participants can function as audience members. Thus, the system provides sufficient functionality in the presentation for a player participant to play the network-wide wagering game event and for the audience member participants to watch and participate as audience members. The system can also present functionality for the player participant to interact with audience members (e.g., multi-way chat features).

The flow 300 continues at processing block 312, where the system presents one or more interactive user features to the audience member users that the audience member users can use to participate as audience members of the network-wide wagering game event. FIG. 6 illustrates an example of a presentation of a network-wide wagering game event (e.g., a site-wide, progressive bonus game) in a web-browser application ("web browser") 602. In FIG. 6, a computer system 645 is connected to a network wagering venue server 650. The computer system 645 presents a display of the web browser 602. The system 600 provides content from the network wagering venue server 650 and presents the content on the web browser 602. The content is related to a wagering game event that is broadcast to multiple users on a website for a network wagering venue. FIG. 6 presents information from the perspective of an audience member of the wagering game event. The web browser 602 includes game play information in a game play section 630 (e.g., playing elements 608 that a player participant avatar 609 appears to select during the wagering game event, game status information in a bonus round progress section 618 related to the player's progress during the wagering game event, etc.). The system 600 can also present features that relate to the network-wide wagering game event, such as betting features. For example, the web browser 602 presents a betting console 631 that the audience member can use to shadow bet, side bet, or perform other wagering activity (e.g., an audience member can bet side-bets on how far a player progresses in the network-wide wagering game event). For example, the web browser 602 can present a selector dropdown control 620 than an audience member participant can use to select a game result graphic that may appear during the wagering game that is being played. The audience member participant can also specify a bet amount in a bet amount control 622 and place the bet using a bet activation control 624. The system 600 can also provide other financial related features, such as account transfer features and "buy-in" features. For instance, an audience member can use "buy-in" controls to buy-in, or pay an amount of money, that would allow the user to win some amount of what the player participant wins (e.g., may not win the full amount that the player would win, but a smaller amount). The system 600 can also present chat features 632 that audience member can use to chat with other audience members participants and with the player participant. The chat features 632 can include a chat display 626 that displays text communications, a chat text entry section 628, a sender selector control 603 and a send activation control 601.

The flow 300 continues at processing block 314, where the system incorporates one or more other network-wide event participants into the network-wide wagering game event. In some embodiments, the system can present special features that reward audience members. For example, the system can include a special game that only audience members can play while watching the network-wide wagering game event. The special game may be only activated for friends of the player participant(s). The system can also provide prizes to audience members for watching the event. The system can provide awards to audience members based on events that occur during the network-wide event (e.g., if the player participant gets to level three, then, because the audience member is watching the event, the audience member gets a prize). In some embodiments, the system can combine qualifying audience member activity with specific events that the player performs from the network-wide wagering game event (e.g., if the audience member is playing the special game, and has bet over $10, and the player participant gets to level three, then the system can provide a prize to the qualifying audience member). In some embodiments, the system can involve an audience member participant in the game play by inserting an identifier (e.g., an avatar) that identifies the audience member and gives the audience member a reward (e.g., a prize, a chance to play special games, a chance to pick items, etc.). For example, in FIG. 6, the system 600 can utilize an avatar 616 associated with the audience member user. The avatar 616 can be associated with a user account belonging to the audience member user (e.g., see avatar 716 belonging to the player account of the current audience member user, PokerAce). Referring still to FIG. 6, the system 600 can present the avatar 616 in connection with logon information 604 on the web browser 602. The system 600 can randomly select one of the audience participants, such as PokerAce, and present its avatar in the game play (see the avatar 616 next to the star element 614 within the game play section 630). The system 600 can then present a notification section 633 notifying the audience member participant (e.g., PokerAce) that its avatar 616 was selected and that an award can be selected via one or more award selection controls (e.g., button 605). In some embodiments, the system 600 can present one or more options for the network-wide wagering game event participant to incorporate one or more social contacts into the network-wide wagering game event (e.g., to pick elements). The player participant can use the options to select audience members as part of the network-wide wagering game event. For instance, a player can select an audience member to play a portion of a wagering game presented in the network-wide event. If the audience member performs positively, or accomplishes a specific goal, then the system 600 can award the player participant for the audience member's activity (e.g., the system 600 can prolong the player's duration in the network-wide wagering game event, the system can increase credit values in the network-wide wagering game event, etc.). For example, in FIG. 6, the system 600 can provide "assistance" functionality, or features, that that permit audience members to assist the player participant in performing a game, or other activity, of the network-wide event. For example, the system 600 can present an assistance section 637 with one or more activity controls 607 that the audience member can select to perform activities (e.g., visit a vendor website, play a game, accept an offer, view an advertisement, make a comment, etc.). In some embodiments, the system 600 can determine the activity that the other network-wide event participants complete and adjust the game rules, results, wagering game playing elements, etc., to enable a higher chance of winning (e.g., produce more win elements, increase the win values to win value elements, produce more progression elements, produce fewer loss elements, etc.). Thus, an audience member's activity can help, or enhance, the player's chance of winning and/or advancing in the network-wide wagering game event.

The flow 300 continues at processing block 316, where the system incorporates one or more outside events into the network-wide wagering game event. In some embodiments, the system can incorporate a predictable event that occurs outside of a wagering game venue (e.g., not a random number generated by wagering venue servers or devices). The outside, or external, event can have a predictable occurrence (e.g., preknown that it will occur), but also has a random value associated with the event when it occurs (e.g., a final value of a stock index, a final score in a sporting event, a result of a Senate vote, etc.). The system can incorporate the random value into the game as a result factor, a bet factor, a selection factor, etc. The outside event could be an event that the system knows about ahead of time, or that occurs regularly, (e.g., a daily ending time of trading for US stock markets), but that has a random result (e.g., the last digit of the Dow Industrial Average at the daily ending time). The system can tie the outside event into account services (e.g., notify the player through the account that the Dow Industrial Average ended at the value). The system can use the outside event as an eligibility condition for being selected to play in a network-wide wagering game event (e.g., "guess the number of the Dow Industrial Average at the end of day to be eligible to receive a network-wide wagering game event.") In some embodiments, the system can select the outside event from a player preference setting and utilize the outside event during the network-wide wagering game event (e.g., select a player setting that indicates that the Dow Industrial Average is a preferred outside event which the system can utilize in conjunction with results, bets, etc.).

Figure 4:
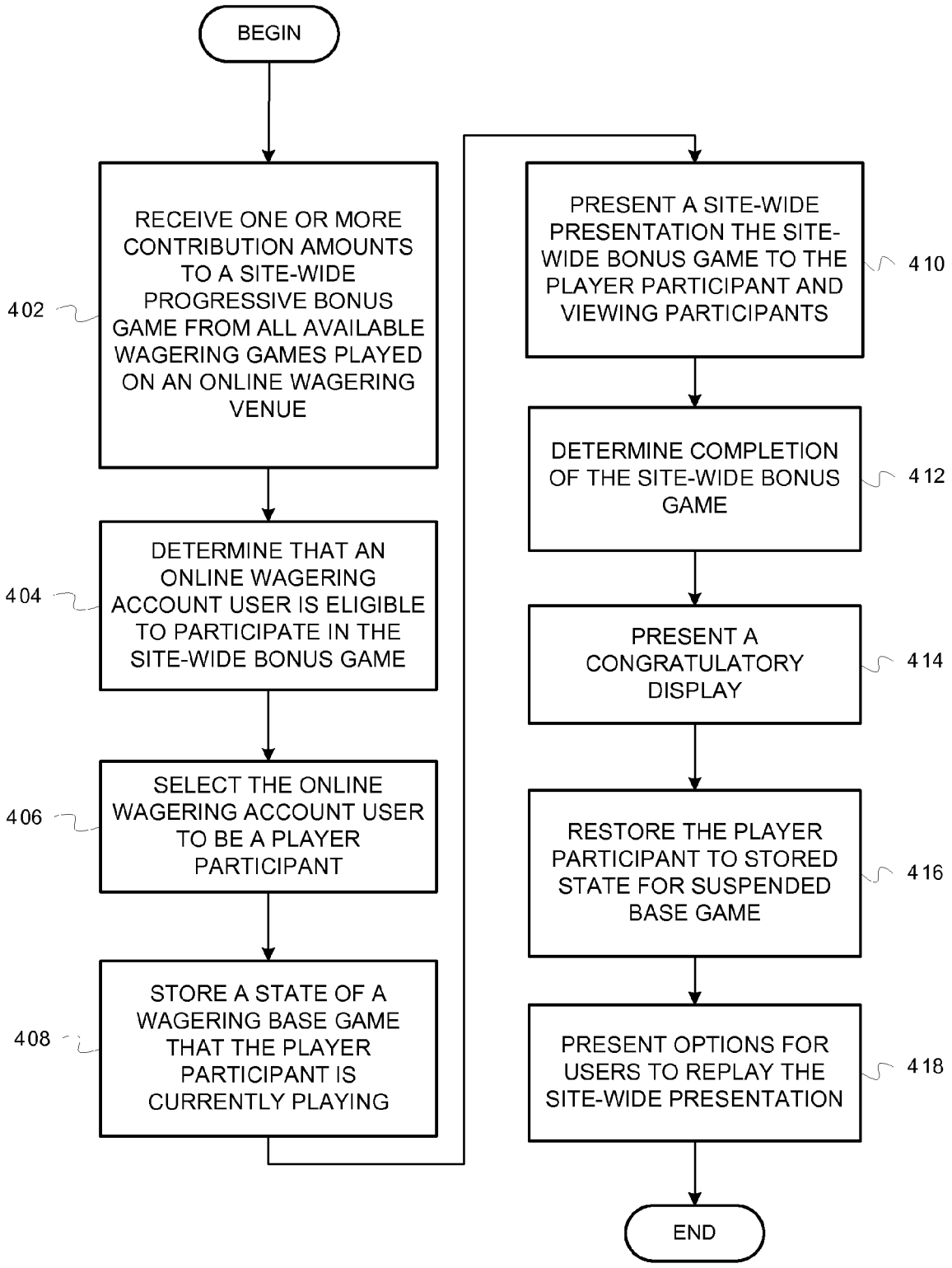
FIG. 4 is a flow diagram 400 illustrating presenting a site-wide, progressive bonus game in an online wagering venue, according to some embodiments.
Figure 5:
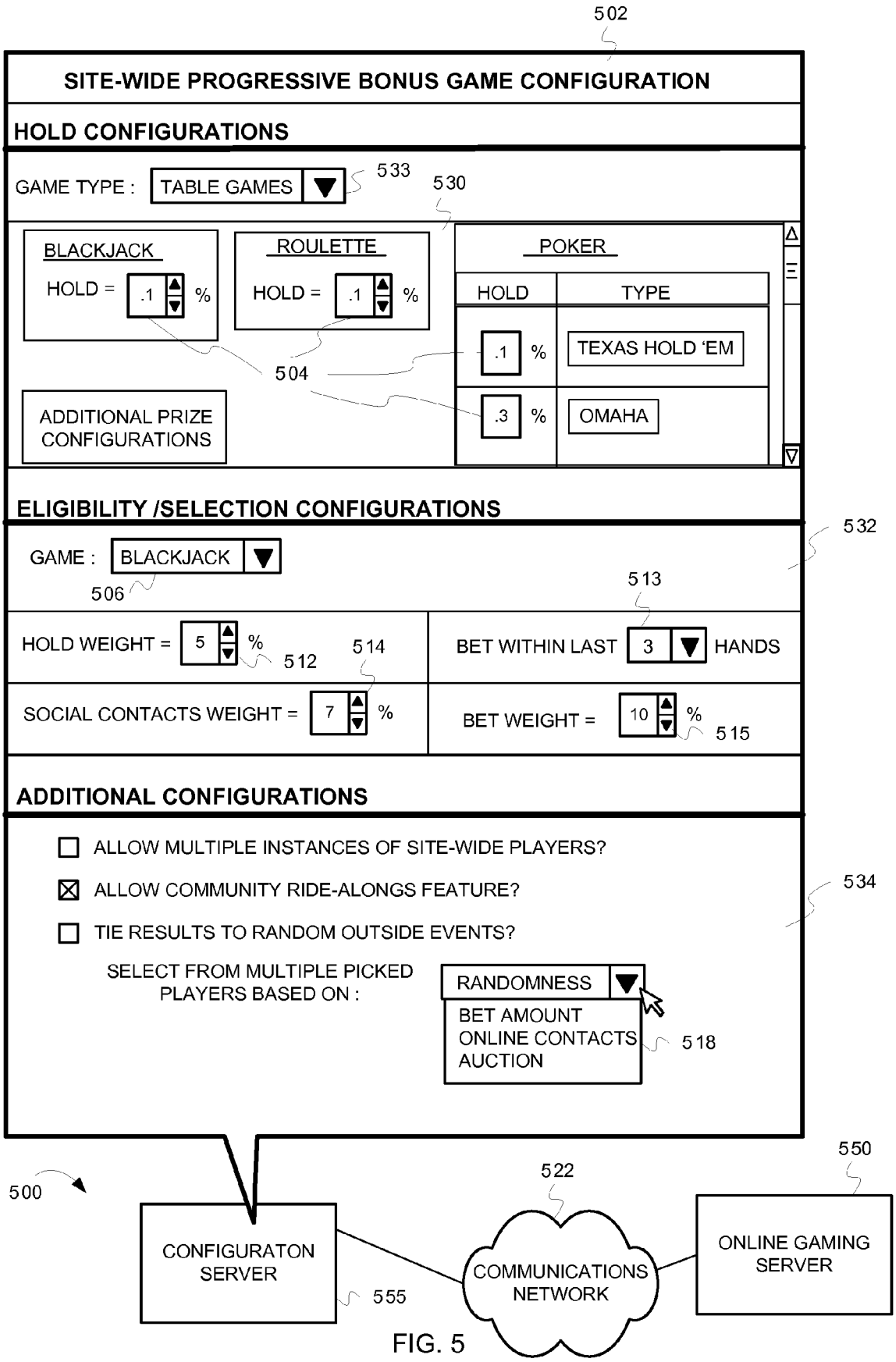
FIG. 5 is an illustration of configuring a site-wide progressive bonus game, according to some embodiments.
Figure 7:
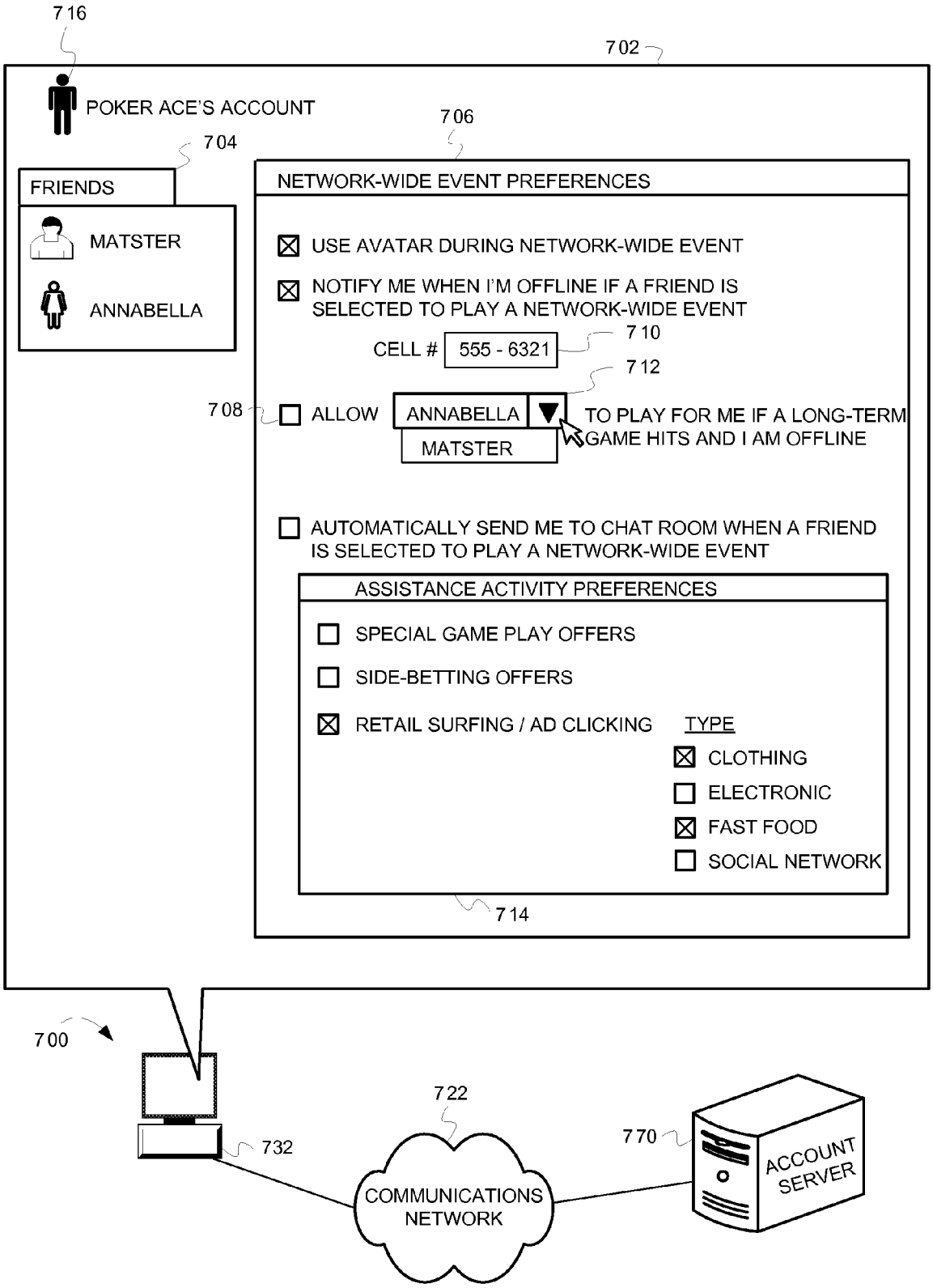
FIG. 7 is an illustration of configuring a user account with network-wide wagering game event preferences, according to some embodiments.

FIG. 4 is a flow diagram ("flow") 400 illustrating presenting a site-wide, progressive bonus game in an online wagering venue, according to some embodiments. FIGS. 5, 6, and 7 are conceptual diagrams that help illustrate the flow of FIG. 4, according to some embodiments. This description will present FIG. 4 in concert with FIGS. 5, 6 and 7. In FIG. 4, the flow 400 begins at processing block 402, where a wagering game system ("system") receives one or more contribution amounts to a site-wide progressive bonus game ("site-wide bonus game") from all available wagering games played on an online wagering venue. A site-wide bonus game is a network-wide event that is broadcast across a web site, or "online" wagering venue, and is thus referred to, in this example, as a "site" wide event. The "event," in this example, is a bonus game based on a progressive jackpot. In some embodiments, the system can configure all available games on the website to contribute a progressive contribution amount, so that any wagering game and/or other gambling activity (e.g., slot games, table games, fixed-odd bets, raffles, bingo, etc.) can potentially trigger the site-wide bonus game. A game that triggers the site-wide bonus game may be referred to as the "base" game, or game from which a portion of the progressive fund was funded, and from which the "bonus" game is initiated. The system can hold a contribution amount ("hold") for all the games and contribute the hold to the progressive jackpot fund, which can be used later during the site-wide bonus game to provide awards to a player participant, and in some cases, to audience member participants. Some games on the website, however, may contribute higher holds than other games, or in other words, contribute a higher percentage of the players bet to the progressive fund. For example, table games (e.g., roulette, black-jack, poker) all may have holds from the base game that are much lower compared to holds from slot games. Consequently, players who play slot games may have higher chances of being selected for the site-wide bonus game. FIG. 5 illustrates an example wagering game system ("system") 500 that includes a configuration server 555 that can configure all wagering games on an online wagering venue to have different holds. The configuration server 555 is connected to an online gaming server 550 (e.g., a wagering game server, a progressive game server, etc.) via a communications network 522. The configuration server 555 can present a configuration display 502 with a game type selector 533. An operator can select the game type selector 533 and the configuration display 502 can present a list 530 of games related to the game type. Each game can have a hold percentage control 504, which can be utilized to set a percentage amount of a player's bet that will be contributed to the site-wide progressive bonus game fund.

The flow 400 continues at processing block 404, where the system determines that an online wagering account user is eligible to participate in the site-wide bonus game. In some embodiments, the system can configure eligibility based on hold percentage and bet amount within a specific time period. For example, in FIG. 5, the configuration display 502 can include a bonus game eligibility section 532 with a game selection control 506. When the game selection control 506 is selected, the system 500 can present several configuration controls (e.g., a hold weight control 512, a social contact weight control 514, a bet weight control 515, and a bet eligibility control 513). Each of the configuration controls 512-515 can indicate values that can be factored into eligibility and selection algorithms for the site-wide bonus game. The bet eligibility selection control 513 can specify a time period, a number of games, or any other condition or factor, for which a player can be eligible to be considered for selection. In some embodiments, the system can include additional configuration settings, such as the additional configurations section 534, which includes settings related to (1) allowing multiple instances of the bonus game, (2) allowing community ride-along features (e.g., special games or prizes for being audience member participants), (3) tying selections and results to events outside of the online wagering venue, (4) selecting a single player from a group of selected, or equally eligible, players, (e.g., via a multiple player selector control 518), etc.

The flow 400 continues at processing block 406, where the system selects the online wagering account user to be a player participant. In some embodiments, the system can select the player participant randomly (e.g., after a hand is completed, a spin is completed, etc.). In some embodiments, however, every individual game on the online wagering venue can have its own specific, unique, chance of triggering. In some embodiments, the player's chances of getting the site-wide bonus game is tied to the amount that the player bets based on the hold. So, the more that a player is contributing to the jackpot, at the time, the greater the chances can be. Also, the more that a game contributes to the jackpot (i.e., the "hold") the greater the chances can be that a player may be selected. The chances of being selected, therefore, can be proportional to both the amount of the bet and the hold for the particular game. For example, some types of games produce more holds—slots may provide ten times more hold than blackjack games. As a result, the system can afford players who play games with higher holds a greater chance of being selected as a performing participant in a network-wide event. Similarly, even amongst the same type of game, some particular game themes may provide greater holds. The system can advertise that some games have greater holds, which may provide players with more incentives to play those specific games instead of others because the chances of getting the jackpot would be higher at the time. The system can configure, and advertise, new games, or less popular games, with higher holds, and, thus, increase interest in the new games or less popular games because they offer higher chances for being selected as a player in a network-wide bonus game event. For example, in FIG. 5, for the game of "blackjack", as selected in the selection control 506, a user on the online wagering venue can have a different chance of being selected to participate in the site-wide progressive bonus game based the value of the user's activity related to the values specified in the configuration controls 512, 514, and 515. For instance, the chances for being selected as a player participant may not be entirely random. A portion of the selection factors may be based on random data, but chances can improve based on the hold for the game, an amount of a user's last bet (or average of last number of bets), a number of social contacts that the user has, etc. For example, the selection process that the system employs may be compared to a wagering pool selection process. In a wagering pool, a player can buy-in to the pool as many times as they want, like in a raffle contest where a player can buy as many raffle tickets as desired. All raffle tickets are then placed into a pool from which a raffle ticket is randomly selected. If a person purchases more raffle tickets than other people, then the person would have a greater chance that one of their tickets would be selected from the ticket selection box, even though the selection of the tickets is blind, or random. Likewise, the system can employ a similar process for selecting a user by using various factors that the user performs or using conditions that exist that are associated with the user, a game played by the user, etc. Thus, based on those factors, a user's chances of being selected can improve. Some factors may include a type of game being played, a hold for a game, an amount of a user's bet, a number of social contacts associated with a user's account, a number of a user's social contacts that are logged on, an amount bet by a user's social contacts within a given time period, an amount of games played within a time period, a degree of loyalty points, an amount of bets over a betting session etc. The configuration controls 512, 514, and 515 show only a few examples of values and activities that can factor into the selection process.

The flow 400 continues at processing block 408, where the system stores a state of a wagering base game ("base game") that the player participant is currently playing. In some embodiments, the system can store the values and conditions of the base game in a database, in a configuration file, in an encrypted drive, etc., and hold the data in a suspended state until the site-wide bonus game is over. The system can present an option (e.g., a "restore" icon) for a site-wide participant to break out of the site-wide bonus game at any time and return to the base game.

The flow 400 continues at processing block 410, where the system presents a site-wide presentation of the site-wide bonus game to the player participant and to one or more viewing participants from the online wagering venue. The system can remove a view of the current game for the site-wide event participant (e.g., the player participant, the viewing participant, etc.), and/or present the site-wide presentation in place of or in higher presentation priority, or prominence, than the suspended base game. In some embodiments, the system can present a site-wide bonus game that has themes and multiple levels, which progress, or advance, through bonus rounds and offer the player multiple levels of opportunities to win amounts from the progressive game fund. FIG. 6 illustrates an example of one kind of themed, multi-level progressive bonus game in the game play section 630. After being selected as a player participant/performer ("player"), the system 600 can present a fanfare, or congratulatory display, to the player. The system 600 can then present a picker grid of game play elements 608 (i.e., graphics, text, objects, or items that a player can use to initiate game play or that a player can manipulate to play the action of the game). A pick-screen appears where the player can pick bonus elements (e.g., 5×5 grid of elements of present graphics). FIG. 6 illustrates an example grid of game play elements 608 (i.e., a 4×2 grid of present graphics). The size of the grid can be different for different rounds of the site-wide bonus game (e.g., can decrease as the rounds get higher). When a player selects one of the game play elements 608, the system 600 can present one of many different game result elements 610 (i.e., a graphic, text, object, or item that presents a wagering game result after the player initiates a game play action). The game play elements 608 can be homogenous. The game result elements 610, however, are unique (e.g., appear different) so that the player knows what the game result was. Examples of game result elements for this example may include a star shaped image ("star"), a dollar sign image ("credit"), and a frowning face image ("pooper"). The star represents a progression result element, or a game result that progresses the play to the next round. The credit represents a win result element with an associated win value (e.g., a credit value), that wins a portion of the progressive fund and that adds to one or more meters for the round and/or an overall meter for the amount of credits won during the site-wide bonus game. The pooper represents a loss result element that will negatively terminate the game without reward, ending the site-wide bonus game. If the site-wide bonus game is in its final round, the site-wide bonus game may also present an ultimate-game-goal result element that may provide an ultimate reward (e.g., the remainder of the progressive fund that had not been won via win result elements). In some embodiments, some site-wide bonus games may not have all of the game result elements listed, whereas some may have additional ones. For example, the site-wide bonus game does not necessarily need an ultimate-game-goal result element as optimal play may be determined by revealing all of the win result elements and avoiding the loss result element. In some embodiments, the system 600 can award jackpots by revealing progression elements. In other words, the progression elements may have jackpot awards associated with them, and the system 600 may or may not utilize win result elements. Further, some bonus games many not have loss result elements, but may instead be timed, and/or provide challenges, that cause a player to lose when time runs out, or when the player acquires enough penalties (e.g., loses all of its lives). Before presenting the game play elements 608 in the grid, the system 600 can randomly associate a specific one of the game result elements 610 with each of the game play elements 608. In other examples, however, the system 600 can randomly associate a game result element 610 during game play (e.g., when the game play element 608 is selected). The system 600 tracks the number of selected game play elements 608 and the number of revealed game result elements 610, and can increase the odds of losing or winning based on what has already been revealed. The system 600 can determine, or detect, when a player selects a game play element 608 (e.g., via mouse click, via touch screen, etc.). The system 600 can then reveal the associated game result element 610. The system 600 can also present an after-selection image 647 that persists during the game to indicate that a game play element 608 had been selected. If the revealed game result element 610 is a progression result element (e.g., the star, like star 614), the system 600 progress the bonus game to next round. If the revealed game result element 610 is a win result element with an associated win value (e.g., the credit value), the system 600 adds the won credit value to a win value meter (e.g., credit meter) for the round and/or to a credit meter for the entire game. If the revealed game result element 610 is a loss result element (e.g., the "pooper"), the system 600 terminates the game without further reward from the progressive funds (although the system 600 may provide consolation awards). If, in a final round, the revealed game result element 610 is an ultimate-game-goal result element, the system 600 can provide a jackpot reward, and terminate the game. The system 600 can present multiple rounds, and game play can continue from round to round until reaching a final round. In each successive round, the system 600 can reduce the chances of progressing to the next round (e.g., can reduce the number of game play elements, can reduce the percentage of available game progression result elements, can increase the percentage of loss result elements, etc.). However, the system 600 can also increase the rewards in that round to be more than the last round (e.g., increase the win values associated with win result elements). In some embodiments, the system 600 can determine one or more activities performed by one or more of the viewing (e.g., audience member) participants and adjust game play for the site-wide bonus game based on the activities. For example, as described previously, an audience member may select an offer via an activity control 607 (or by performing one of many other types of activities). The system 600 can improve the chances of game play by reevaluating game result elements that are associated with game play elements 608 and making the odds more favorable to the player of winning or progressing, based on the rules and conditions of the game. For example, in the example of the site-wide bonus game, the system 600 can determine that some audience members have completed the suggested activities and, subsequently, remove or replace unrevealed loss elements with win result elements or progression result elements. In some embodiments, the system 600 may increase second chances opportunities (e.g., add extra lives) to a player's game based on those activities, or extend a player's amount of time in a bonus game (e.g., if the game is timed, the audience members activity can prolong the time, giving the player more time to select win result elements). The system 600 can represent progress through rounds in certain ways. In FIG. 6, the system 600 tracks the round progress in the bonus round progress section 618, showing credit amounts won for each round. In other embodiments, the system can track rounds by displaying a number of stars in a progress bar or meter.

The flow 400 continues at processing block 412, where the system determines a completion of the site-wide bonus game. As stated previously, game play can be basic and straightforward. Players entering the site-wide bonus can be prompted to select presents to reveal awards. Credit amounts are awarded to the player, and are collected in the credit meters (some credit values can be tied to an amount that a player had bet before entering the site-wide bonus round, thus encouraging players to bet larger amounts during base-game play). Players that receive a star advance to the next round, taking with them the credits they accumulated in each round far. When a player reveals a pooper, however, game play terminates. If the player plays optimally, meaning the player avoids the pooper, and progresses through all rounds, the game play terminates after revealing the final winning game result element. During the game play, the system can refer to various account preferences set by a site-wide bonus game participant. FIG. 7 illustrates an example. In FIG. 7, a wagering game system ("system") 700 includes a client computer system ("client") 732 connected to an account server 770 via a communications network 722. The client 732 can present a user account 702. The user account 702 can include an avatar 716 associated with a user for user account 702. The user account 702 can also list friends, or social contacts 704, that are other accounts on the account server 770, or other account servers, social network, etc., that are associated with the user account. The user account 702 can also include network-wide event preferences ("preferences") 706, or preferences that a wagering game server, or other devices, can refer to when presenting network-wide wagering game events to player participants or audience members. The preferences 706 can include user settings that relate to various preferences, such as use of avatars, notifications of events, wagering agency, automated presentation of network-wide events, assistance activities during network-wide events, etc. For example, the preferences 706 can include a mobile phone number field 710 that will call a mobile phone to notify a user when a friend is selected to participate in a network-wide event. The preferences 706 can also include an agent selection control 712 to select a friend, a bot, or some other agent, to play a network-wide wagering game event if the user account is selected and cannot log on quickly enough or play remotely. The preferences 706 can also include activity preferences 714 that the user account would prefer regarding marketing type activities that the user could perform during network-wide wagering game events to help, or assist, a player to improve their chances at winning during the event. The activity preferences 714 can include marketing demographic information, advertising types, betting preferences, offer preferences, etc.

The flow 400 continues at processing block 414, where the system presents a congratulatory display. In some embodiments, the system can present a pop-out screen that congratulates the player when player completes the site-wide bonus game.

The flow 400 continues at processing block 416, where the system restores the player participant to the stored state for the suspended base game. If the base game was removed from view, the system can return the view of the base game to how it appeared before entering the bonus game. The system can update the view of the base game, however, with any changes to account balances or displays of awards or accomplishments that occurred during the site-wide wagering game event. If the base game was minimized, the system maximizes the base game and returns it to a position of prominence on the participants display. The system can return any news feeds, which originally may have notified the bonus game participants, to their normal states. The system can report a news item on the news feed detailing the win of that player, and giving other players the opportunity to see the playback of the win, the winning player's profile, etc.

The flow 400 continues at processing block 418, where the system presents options for a user to replay the site-wide presentation. In some embodiments, the system can present a pop-out screen, and other option/feature, to the player, or other users, to replay the site-wide presentation of the site-wide bonus game.

Additional Example Embodiments

According to some embodiments, a wagering game system ("system") can provide various example devices, operations, etc., to present network-wide wagering game events in a network wagering venue. The following non-exhaustive list enumerates some possible embodiments.

In some embodiments, the system can present various types of wagering game events that can be based on various types of award structures. One award structure mentioned above was a progressive jackpot award. Other types of award structures may include awarding any number of free items (e.g., free-spins, merchandise, entries into tournaments), sweepstakes awards, status awards, loyalty point awards, etc.

In some embodiments, the system can associate events and awards with outside vendors (e.g., Target™ Inc. can sponsor an event where awards are shopping sprees or discounts at Target™ stores).

In some embodiments, the system can provide options for a player to design their own ball to be placed in a bingo game. A player can then complete qualifying conditions or tasks (e.g., plays games, collects items, bets large denominations, receives card configurations, etc.) within the network wagering venue. For each qualifying condition or task, the system can enter one of the player's personalized balls into the bingo game. The more conditions and tasks that the player completes, the greater the chance that the player would have of being selected for play or awards of a network-wide wagering game event.

In some embodiments, the system can utilize symbols that show up in every game (e.g., a spot on a board that no-one picked, a slot symbol, a symbol on a card, etc.) to signify qualifying conditions for being selected to play or receive awards during a network-wide event. The amount of the symbols that appear can be based on the type of game playing (e.g., if playing cards, then maybe need two symbols to qualify for the bonus round). The symbols/bonus rounds can be time based (e.g., for next two-minutes, if playing roulette, if an event occurs, or a symbol occurs, then can get into the bonus round; for the next five-minutes, every player playing blackjack will win a prize if a dealer hits a black-jack).

In some embodiments, the system can base eligibility on events that occur throughout a pre-party period. For example, the system can send out invitations to a pre-planned event. To be eligible for selection as a player participant, a user would need to qualify by betting a specific amount of money during the week, signing up for social programs, connecting with a number of social network contacts, clicking on a certain number of ads, etc.

Additional Example Operating Environments

This section describes example operating environments, systems and networks, and presents structural aspects of some embodiments.

Client Computer System

Figure 8:
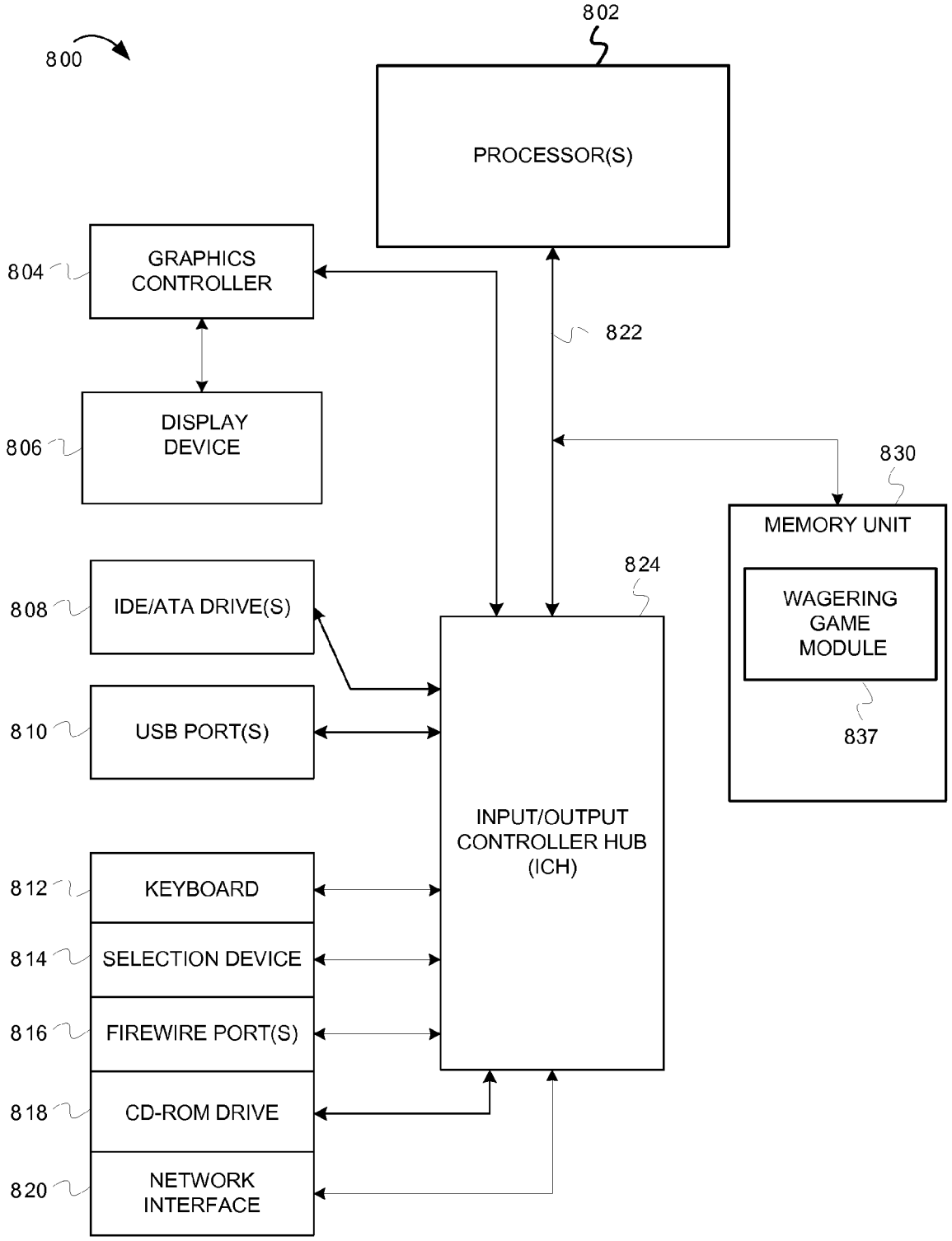
FIG. 8 is an illustration of a client computer system 800, according to some embodiments.

FIG. 8 is a conceptual diagram that illustrates an example of a client computer system ("computer system") 800, according to some embodiments. As shown in FIG. 8, the computer system 800 may include a processor unit 802, a memory unit 830, a processor bus 822, and an Input/Output controller hub (ICH) 824. The processor unit 802, memory unit 830, and ICH 824 may be coupled to the processor bus 822. The processor unit 802 may comprise any suitable processor architecture. The computer system 800 may comprise one, two, three, or more processors, any of which may execute a set of instructions in accordance with some embodiments.

The memory unit 830 may also include an I/O scheduling policy unit 832 and I/O schedulers 834. The memory unit 830 can store data and/or instructions, and may comprise any suitable memory, such as a dynamic random access memory (DRAM), for example. The computer system 800 may also include IDE drive(s) 808 and/or other suitable storage devices. A graphics controller 804 controls the display of information on a display device 806, according to some embodiments.

The input/output controller hub (ICH) 824 provides an interface to I/O devices or peripheral components for the computer system 800. The ICH 824 may comprise any suitable interface controller to provide for any suitable communication link to the processor unit 802, memory unit 830 and/or to any suitable device or component in communication with the ICH 824. The ICH 824 can provide suitable arbitration and buffering for each interface.

For one embodiment, the ICH 824 provides an interface to one or more suitable integrated drive electronics (IDE) drives 808, such as a hard disk drive (HDD) or compact disc read only memory (CD ROM) drive, or to suitable universal serial bus (USB) devices through one or more USB ports 810. For one embodiment, the ICH 824 also provides an interface to a keyboard 812, selection device 814 (e.g., a mouse, trackball, touchpad, etc.), CD-ROM drive 818, and one or more suitable devices through one or more firewire ports 816. For one embodiment, the ICH 824 also provides a network interface 820 though which the computer system 800 can communicate with other computers and/or devices.

The computer system 800 may also include a machine-readable medium that stores a set of instructions (e.g., software) embodying any one, or all, of the methodologies for presenting network-wide wagering game events in a network wagering venue. Furthermore, software can reside, completely or at least partially, within the memory unit 830 and/or within the processor unit 802. The computer system 800 can also include a wagering game module 837. The wagering game module 837 can process communications, commands, or other information, to present network-wide wagering game events in a network wagering venue. Any component of the computer system 800 can be implemented as hardware, firmware, and/or machine-readable media including instructions for performing the operations described herein.

Personal Wagering Game System

Figure 9:
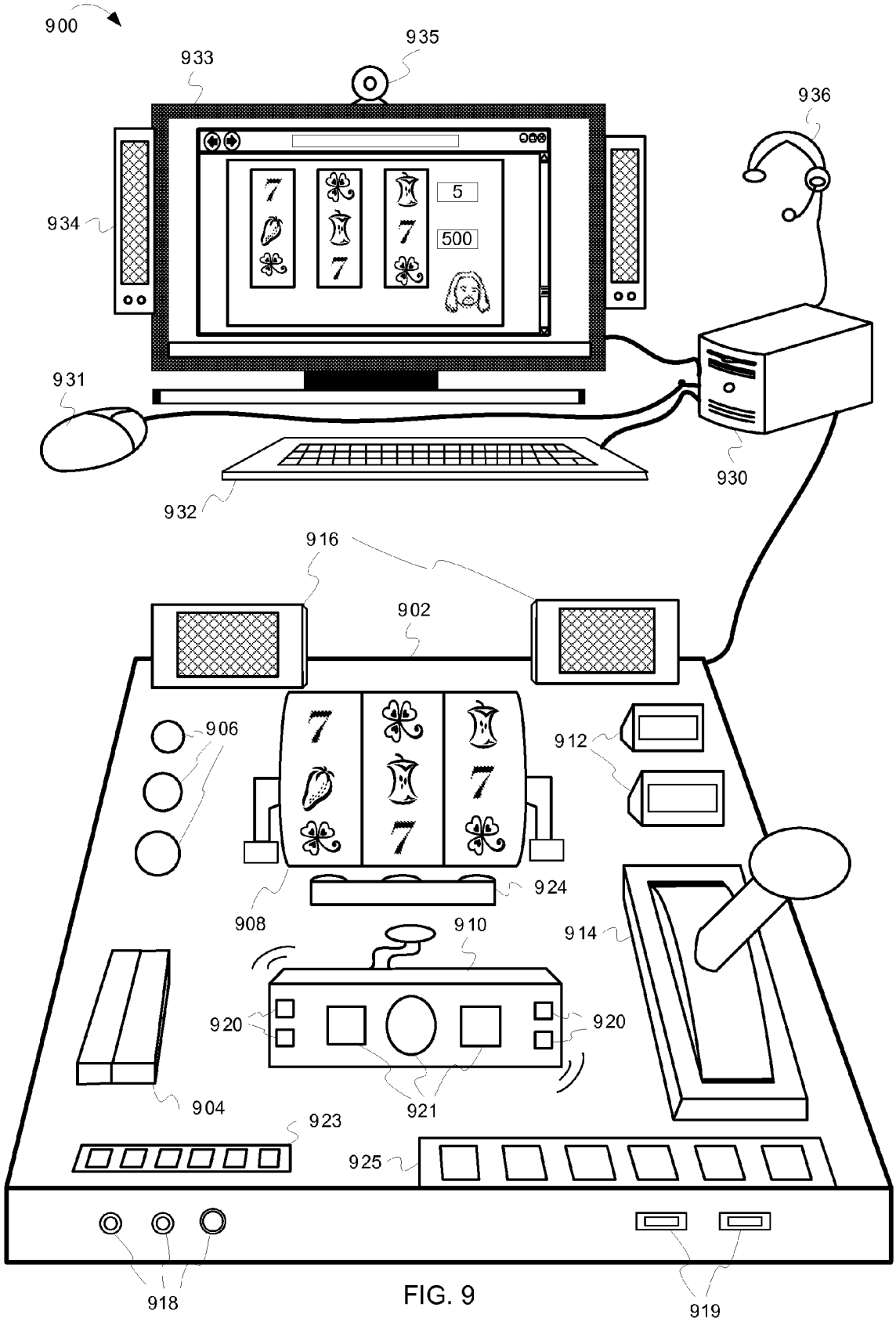
FIG. 9 is an illustration of a personal wagering game system 900, according to some embodiments.

FIG. 9 is a conceptual diagram that illustrates an example of a personal wagering game system 900, according to some embodiments. In FIG. 9, the personal wagering game system ("system") 900 includes an exemplary computer system 930 connected to several devices, including user input devices (e.g., a keyboard 932, a mouse 931), a web-cam 935, a monitor 933, speakers 934, and a headset 936 that includes a microphone and a listening device. In some embodiments, the webcam 935 can detect fine details of a person's facial features, from an eye-level perspective. The web-cam 935 can use the fine detail to determine a person's identity, their demeanor, their facial expressions, their mood, their activities, their eye focus, etc. The headset 936 can include biometric sensors configured to detect voice patterns, spoken languages, spoken commands, etc. The biometric sensors in the web-cam 935 can detect colors (e.g., skin colors, eye colors, hair colors, clothing colors, etc.) and textures (e.g., clothing material, scars, etc.). The biometric sensors in the web-cam 935 can also measure distances between facial features (e.g., distance between eyes, distance from eyes to nose, distance from nose to lips, length of lips, etc.). The system 900 can generate a facial and body map using the detected colors, textures, and facial measurements. The system 900 can use the facial and body map to generate similar facial features and body appearances for a player account avatar. Also connected to the computer system 930 is a gaming control device ("gaming pad") 902 including wagering game accoutrements associated with wagering games. The wagering game accoutrements include one or more of prop reels 908, prop game meters 912, indicators 906, a game control device 910, a physical lever 914, a magnetic card reader 904, a video projection device 924, input/output ports 918, USB ports 919, and speakers 916. The gaming pad 902 can present feedback of online activities. For instance, the gaming pad 902 can use vibrations and signals on the gaming control device (e.g., the game control device 910 or the physical level 914 can vibrate to indicate a back pat from another player or a game celebration, the indicators 906 can blink, etc.). The physical lever 914 can produce feelings in the lever to emulate a pulling feel or a vibration. The video projection device 924 can project video onto the props reels 908 so that the prop reels 908 can present many different types of wagering games. The prop reels 908 can spin when the physical lever 914 is pulled. The video projection device 924 can project reel icons onto the prop reels 908 as they spin. The video projection device 924 can also project reel icons onto the prop reels 908 when the prop reels 908 are stationary, but the imagery from the video project device 924 makes the prop reels 908 appear to spin. The magnetic card reader 904 can be used to swipe a credit card, a player card, or other cards, so that the system can quickly get information. The system 900 can offer lower rates for using the magnetic card reader 904 (e.g., to get a lower rate per transaction). The game control device 910 can include an emotion indicator keypad with keys 920 that a player can use to indicate emotions. The game control device 910 can also include biometric devices 921 such as a heart-rate monitor, an eye pupil dilation detector, a fingerprint scanner, a retinal scanner, voice detectors, speech recognition microphones, motion sensors, sound detectors, etc. The biometric devices 921 can be located in other places, such as in the headset 936, within a chair (not shown), within personal control devices (e.g. joysticks, remote controls, game pads, roller-balls, touch-pads, touch-screens, etc.), within the web-cam 935, or any other external device. The external devices can be connected to the computer 930 or to the game control device 910 via the input/output ports 918. As a security feature, some biometric devices can be associated with some of the gaming pad devices (e.g., the magnetic card reader 904), such as a fingerprint scanner, a retinal scanner, a signature pad to recognize a player's signature, etc. The game control device 910 can also use the keys 920 to share items and control avatars, icons, game activity, movement, etc. within a network wagering venue. The game pad can also have an electronic (e.g., digital) button panel 925, an electronic control panel 923, or any other type of changeable panel that can change appearance and/or configuration based on the game being played, the action being performed, and/or other activity presented within an online gaming venue. The game control device 910 can also move in different directions to control activity within the online gaming venue (e.g., movement of a player's avatar moves in response to the movements of the game control device 910). Avatars can be pre-programmed to act and look in certain ways, which the player can control using the system 900. The gaming pad 902 can permit the player to move the avatar fluidly and more easily than is possible using a standard keyboard. The system 900 can cause an avatar to respond to input that a player receives via the gaming pad 902. For example, a player may hear a sound that comes primarily from one direction (e.g., via stereophonic signals in the headset 936) within the network wagering venue. The system 900 can detect the movement of the player (e.g., the system 900 detects that a player moves his head to look in the direction of the sound, the player uses the game control device 910 to move the avatar's perspective to the direction of the sound, etc.). The system 900 can consequently move the avatar's head and/or the avatar's perspective in response to the player's movement. The player can indicate an expression of an emotion indicated by the player using the keys 920. The system 900 can make the avatar's appearance change to reflect the indicated emotion. The system 900 can respond to other movements or actions by the player and fluidly move the avatar to respond. The system 900 can also interpret data provided by the biometric devices and determine expressions and/or indications of emotions for a player using the system 900.

Wagering Game Machine Architecture

Figure 10:
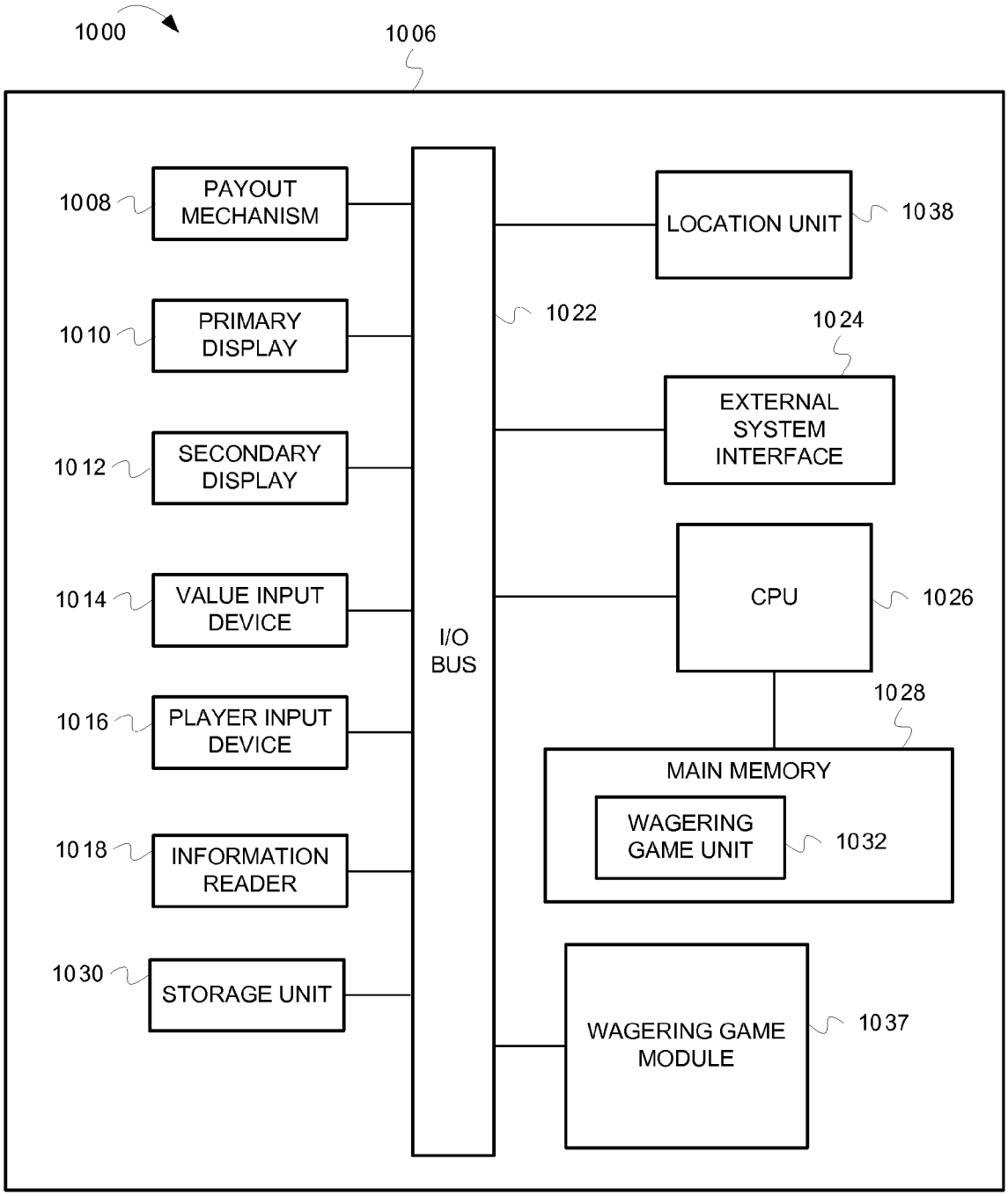
FIG. 10 is an illustration of a wagering game machine architecture 1000, according to some embodiments.

FIG. 10 is a conceptual diagram that illustrates an example of a wagering game machine architecture 1000, according to some embodiments. In FIG. 10, the wagering game machine architecture 1000 includes a wagering game machine 1006, which includes a central processing unit (CPU) 1026 connected to main memory 1028. The CPU 1026 can include any suitable processor, such as an Intel® Pentium processor, Intel® Core 2 Duo processor, AMD Opteron™ processor, or UltraSPARC processor. The main memory 1028 includes a wagering game unit 1032. In some embodiments, the wagering game unit 1032 can present wagering games, such as video poker, video black jack, video slots, video lottery, reel slots, etc., in whole or part.

The CPU 1026 is also connected to an input/output ("I/O") bus 1022, which can include any suitable bus technologies, such as an AGTL+ frontside bus and a PCI backside bus. The I/O bus 1022 is connected to a payout mechanism 1008, primary display 1010, secondary display 1012, value input device 1014, player input device 1016, information reader 1018, and storage unit 1030. The player input device 1016 can include the value input device 1014 to the extent the player input device 1016 is used to place wagers. The I/O bus 1022 is also connected to an external system interface 1024, which is connected to external systems (e.g., wagering game networks). The external system interface 1024 can include logic for exchanging information over wired and wireless networks (e.g., 802.11g transceiver, Bluetooth transceiver, Ethernet transceiver, etc.)

The I/O bus 1022 is also connected to a location unit 1038. The location unit 1038 can create player information that indicates the wagering game machine's location/movements in a casino. In some embodiments, the location unit 1038 includes a global positioning system (GPS) receiver that can determine the wagering game machine's location using GPS satellites. In other embodiments, the location unit 1038 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 10, in some embodiments, the location unit 1038 is not connected to the I/O bus 1022.

In some embodiments, the wagering game machine 1006 can include additional peripheral devices and/or more than one of each component shown in FIG. 10. For example, in some embodiments, the wagering game machine 1006 can include multiple external system interfaces 1024 and/or multiple CPUs 1026. In some embodiments, any of the components can be integrated or subdivided.

In some embodiments, the wagering game machine 1006 includes a wagering game module 1037. The wagering game module 1037 can process communications, commands, or other information, where the processing can present network-wide, wagering game events in a network wagering venue.

Furthermore, any component of the wagering game machine 1006 can include hardware, firmware, and/or machine-readable media including instructions for performing the operations described herein.

Mobile Wagering Game Machine

Figure 11:
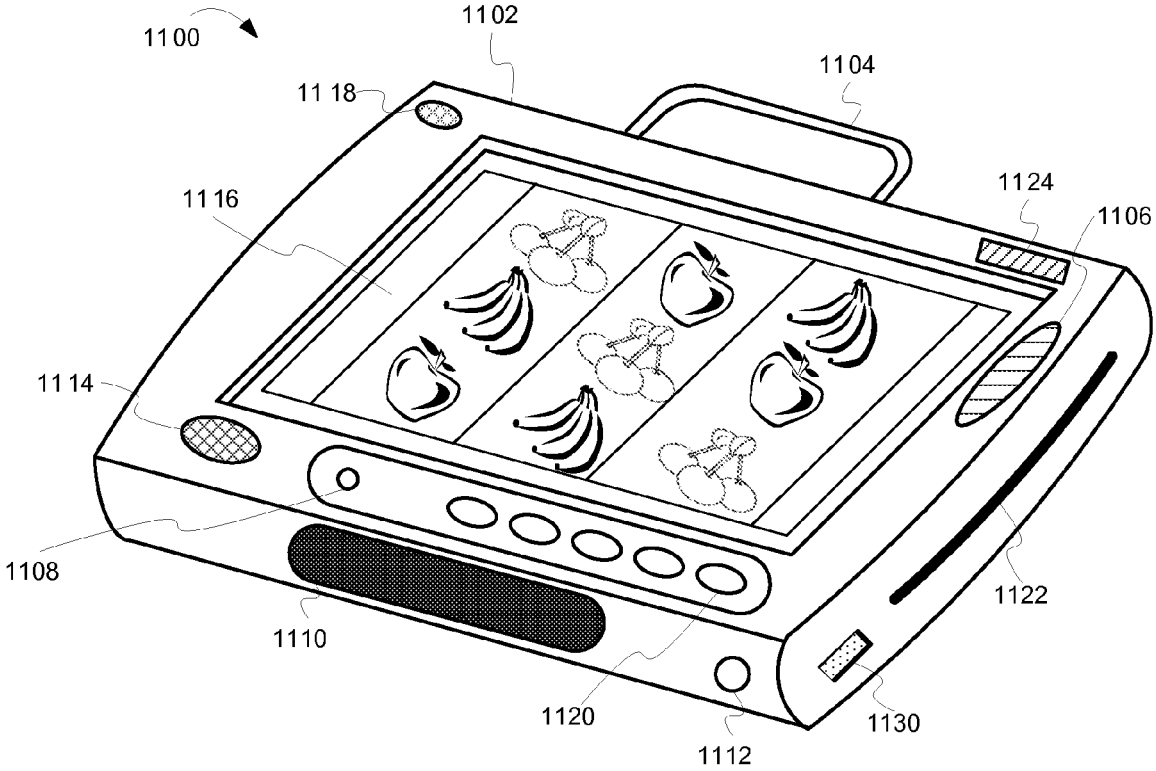
FIG. 11 is an illustration of a mobile wagering game machine 1100, according to some embodiments.

FIG. 11 is a conceptual diagram that illustrates an example of a mobile wagering game machine 1100, according to some embodiments. In FIG. 11, the mobile wagering game machine 1100 includes a housing 1102 for containing internal hardware and/or software such as that described above vis-à-vis FIG. 10. In some embodiments, the housing has a form factor similar to a tablet PC, while other embodiments have different form factors. For example, the mobile wagering game machine 1100 can exhibit smaller form factors, similar to those associated with personal digital assistants. In some embodiments, a handle 1104 is attached to the housing 1102. Additionally, the housing can store a foldout stand 1110, which can hold the mobile wagering game machine 1100 upright or semi-upright on a table or other flat surface.

The mobile wagering game machine 1100 includes several input/output devices. In particular, the mobile wagering game machine 1100 includes buttons 1120, audio jack 1108, speaker 1114, display 1116, biometric device 1106, wireless transmission devices (e.g., wireless communication units 1112 and 1124), microphone 1118, and card reader 1122. Additionally, the mobile wagering game machine can include tilt, orientation, ambient light, or other environmental sensors.

In some embodiments, the mobile wagering game machine 1100 uses the biometric device 1106 for authenticating players, whereas it uses the display 1116 and the speaker 1114 for presenting wagering game results and other information (e.g., credits, progressive jackpots, etc.). The mobile wagering game machine 1100 can also present audio through the audio jack 1108 or through a wireless link such as Bluetooth.

In some embodiments, the wireless communication unit 1112 can include infrared wireless communications technology for receiving wagering game content while docked in a wager gaming station. The wireless communication unit 1124 can include an 802.11G transceiver for connecting to and exchanging information with wireless access points. The wireless communication unit 1124 can include a Bluetooth transceiver for exchanging information with other Bluetooth enabled devices.

In some embodiments, the mobile wagering game machine 1100 is constructed from damage resistant materials, such as polymer plastics. Portions of the mobile wagering game machine 1100 can be constructed from non-porous plastics which exhibit antimicrobial qualities. Also, the mobile wagering game machine 1100 can be liquid resistant for easy cleaning and sanitization.

In some embodiments, the mobile wagering game machine 1100 can also include an input/output ("I/O") port 1130 for connecting directly to another device, such as to a peripheral device, a secondary mobile machine, etc. Furthermore, any component of the mobile wagering game machine 1100 can include hardware, firmware, and/or machine-readable media including instructions for performing the operations described herein.

The described embodiments may be provided as a computer program product, or software, that may include a machine-readable medium having stored thereon instructions, which may be used to program a computer system (or other electronic device(s)) to perform a process according to embodiments(s), whether presently described or not, because every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

GENERAL

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method comprising:

generating content that depicts a wagering game;

providing the content to a plurality of machines via a wagering game network venue, wherein the plurality of machines are configured to receive the content and present a depiction of the wagering game, wherein a first machine, from the plurality of machines, is associated with a first user that plays the wagering game, and wherein a second machine, from the plurality of machines, is associated with a second user that views the wagering game as an audience member;

detecting a first user input associated with the second machine, said first user input indicating performance of an activity by the second user; and increasing a chance that a second user input associated with the first machine will result in a winning outcome of the wagering game in response to detecting the first user input associated with the second machine.

2. The method of claim 1, wherein the activity is one or more of visiting a specific website, playing a game, accepting an offer, and viewing an advertisement.

3. The method of claim 1, wherein increasing the chance that the second user input associated with the first machine will result in the winning outcome of the wagering game comprises modifying one or more of game rules for the wagering game and a number of game elements of the wagering game.

4. The method of claim 1 further comprising selecting the first user to play the wagering game based on one or more of a number of social contacts associated with the first user, activity of friends associated with the first user, and an auction.

5. The method of claim 1 further comprising presenting via the network wagering venue a counter that indicates a short time period before the network-wide wagering game event will occur.

6. The method of claim 1 further comprising:

detecting a third user input, via the first machine, during the wagering game, wherein the third user input indicates a selection, by the first user, of the second user to play a portion of the wagering game; and assigning control of the portion of the wagering game to the second machine in response to the third user input.

7. The method of claim 1 further comprising presenting one or more features via the second machine, wherein the one or more features are configured to receive, from the second user, one or more of shadow betting and side betting on a performance of the first user in the wagering game.

8. An apparatus comprising:

a processor; and a wagering game module configured to, via the processor detect a payment by a first user of an amount of money via an online wagering venue, select the first user to play a bonus game on the online wagering venue in response to the payment by the first user of the amount of money, generate content that depicts the bonus game, present the content via the online wagering venue, said content configured to receive first user input from the first user to play the bonus game and receive second user input from second users to participate as audience members of the bonus game, detect performance of social communications by the second users via the content while the first user plays the bonus game, and increase a chance that the bonus game will result in a winning outcome in response to the performance of the social communications by the second users.

9. The apparatus of claim 8, wherein the wagering game module is configured to detect the performance of the social communications by the second users via the content while the first user plays the bonus game being configured to present chat controls in the content; and detect use of the chat controls by the second users while the first user plays the bonus game.

10. The apparatus of claim 9, wherein the wagering game module is configured to detect the payment by the first user of the amount of money via an online wagering venue being configured to present additional content configured to accept bids for an auction to play the bonus game, detect a high bid for the auction user of the additional content, wherein the high bid is associated with the first user, and obtain the payment via a player account associated with the first user, wherein the payment is equivalent to the high bid.

11. An apparatus comprising:

means for selecting a player to control play in a network-wide wagering game event on a network wagering venue, wherein audience members, associated with the network wagering venue, view the network wagering venue via web browsers;

means for detecting a selection by the player of one of the audience members to control the wagering game elements during at least a portion of the network-wide wagering game event;

means for detecting user inputs by the one of the audience members during the portion of the network-wide wagering game event via one of the web browsers associated with the one of the audience members;

means for generating, in response to the user inputs, one or more winning outcomes of the network-wide wagering game event; and means for awarding one or more of the player and the one of the audience members in response to generating the one or more winning outcomes of the network-wide wagering game event.

12. The apparatus of claim 11 further comprising:

means for presenting a game for the audience members to play during the network-wide wagering game event;

means for generating, in response to play by the first user, one or more additional winning outcomes of the network-wide wagering game event; and means for awarding the audience members via the game based at least in part on the one or more additional winning outcomes.

13. The apparatus of claim 11 further comprising:

means for determining one or more activities performed by one or more of the audience members; and means for increasing chances of the player obtaining a desired goal in the network-wide wagering game event based on the one or more activities.

14. The apparatus of claim 11, wherein the means for selecting the player to control the play in the network-wide wagering game event further comprises, means for detecting an outcome of an a non-gaming event that occurs external to the network wagering venue, wherein the non-gaming event has a predictable occurrence with a random value;

means for determining that the player correctly guessed the random value; and means for selecting the player to control the play in the network-wide wagering game in response to determining that the player correctly guessed the random value.

* * * * *